US005459649A

United States Patent [19]

Ellion

[11] Patent Number: 5,459,649

[45] Date of Patent: Oct. 17, 1995

[54] FLASHLIGHT WITH AN ENHANCED SPOT BEAM AND A FULLY ILLUMINATED BROAD BEAM

[76] Inventor: M. Edmund Ellion, 3660 Woodstock Rd., Santa Ynez, Calif. 93460

[21] Appl. No.: 44,781

[22] Filed: Apr. 6, 1993

Related U.S. Application Data

[63] Continuation-in-part of Ser. No. 685,086, Apr. 10, 1991, abandoned, which is a continuation-in-part of Ser. No. 951,184, Sep. 28, 1992, abandoned.

[51] Int. Cl.[6] ..... F21L 7/00

[52] U.S. Cl. ..... 362/187; 362/282; 362/346; 362/347

[58] Field of Search ..... 362/187, 188, 362/203, 282, 284, 285, 297, 304, 346, 350, 347, 200

[56] References Cited

U.S. PATENT DOCUMENTS

| | | | |
|---|---|---|---|
| 1,991,753 | 2/1935 | Kurlander | 362/187 |
| 4,398,238 | 8/1983 | Nelson | 362/187 |
| 4,605,994 | 8/1986 | Krieg | 362/187 X |

*Primary Examiner*—Stephen F. Husar
*Attorney, Agent, or Firm*—Donald D. Mon

[57] ABSTRACT

A flashlight which selectively provides an enhanced spot beam and fully illuminated broad beam. The modified parabolic reflector produces with either a point source of light or an extended filament source of light a spot beam which is substantially more uniform across its disc as is produced by a conventional parabolic reflector, and a greatly improved broad beam without unilluminated areas. Further, the range of distance in which these effects are provided is importantly increased.

29 Claims, 12 Drawing Sheets

1
2
3
4
6
7
8
51
52
52a
52b
52c
53
54
61
61a
62
63
64
65
a
b
c
d
e
r

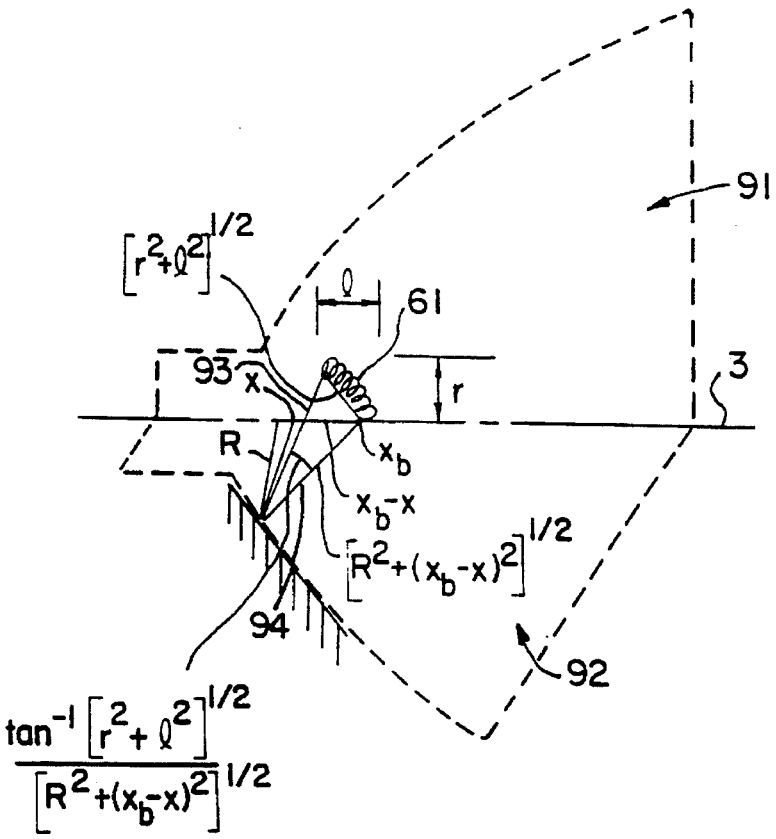
FIG. 9
FIG. 10
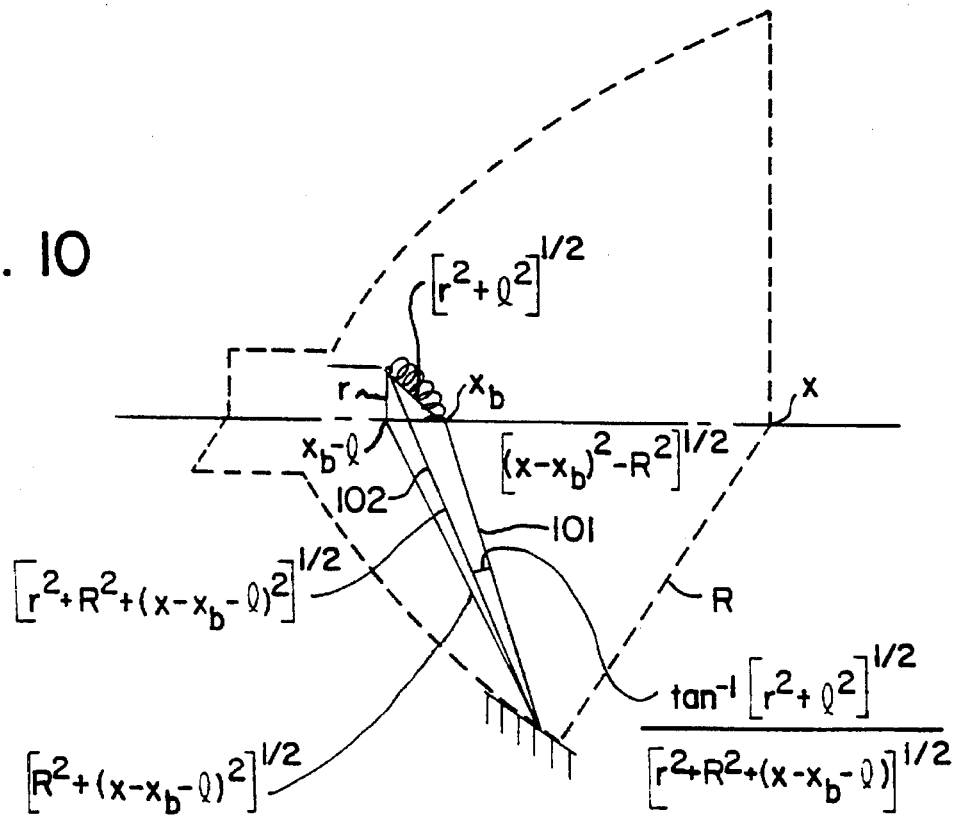

FIG. 11
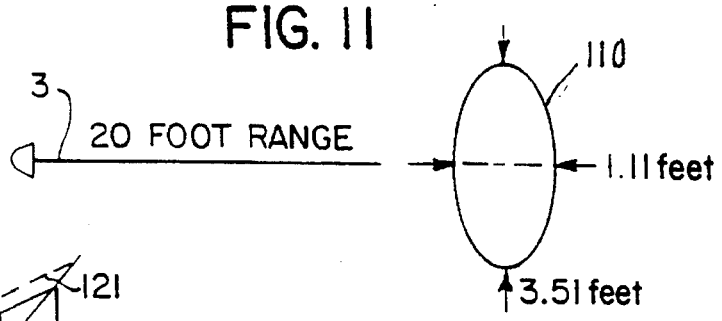
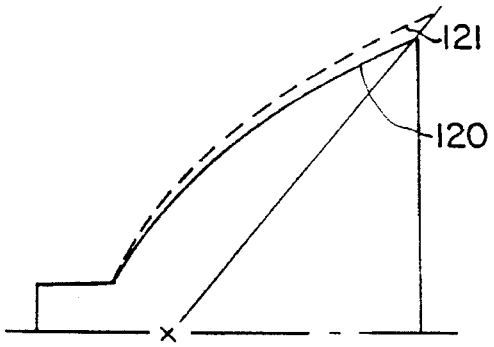
FIG. 12
FIG. 13
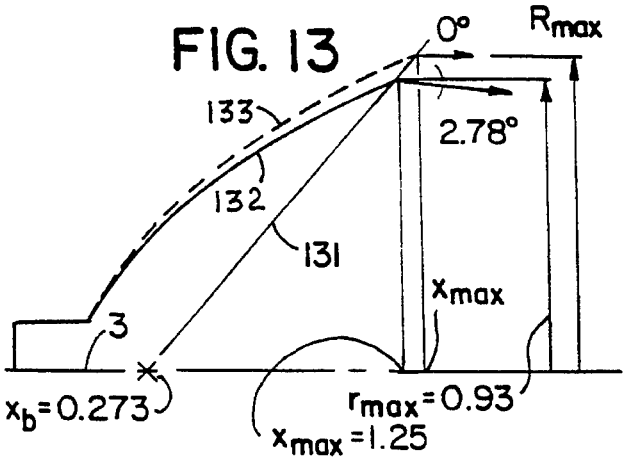
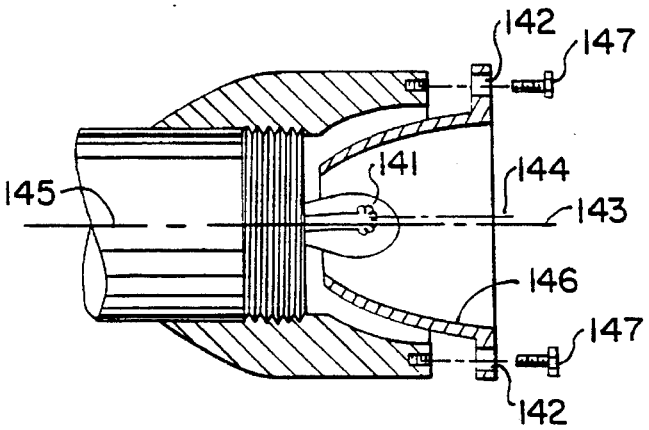
FIG. 14
FIG. 15
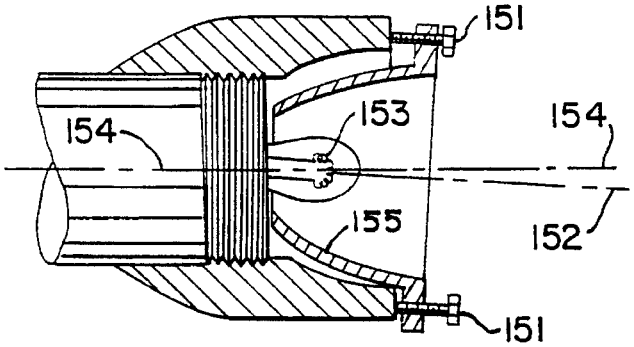

FIG. 24
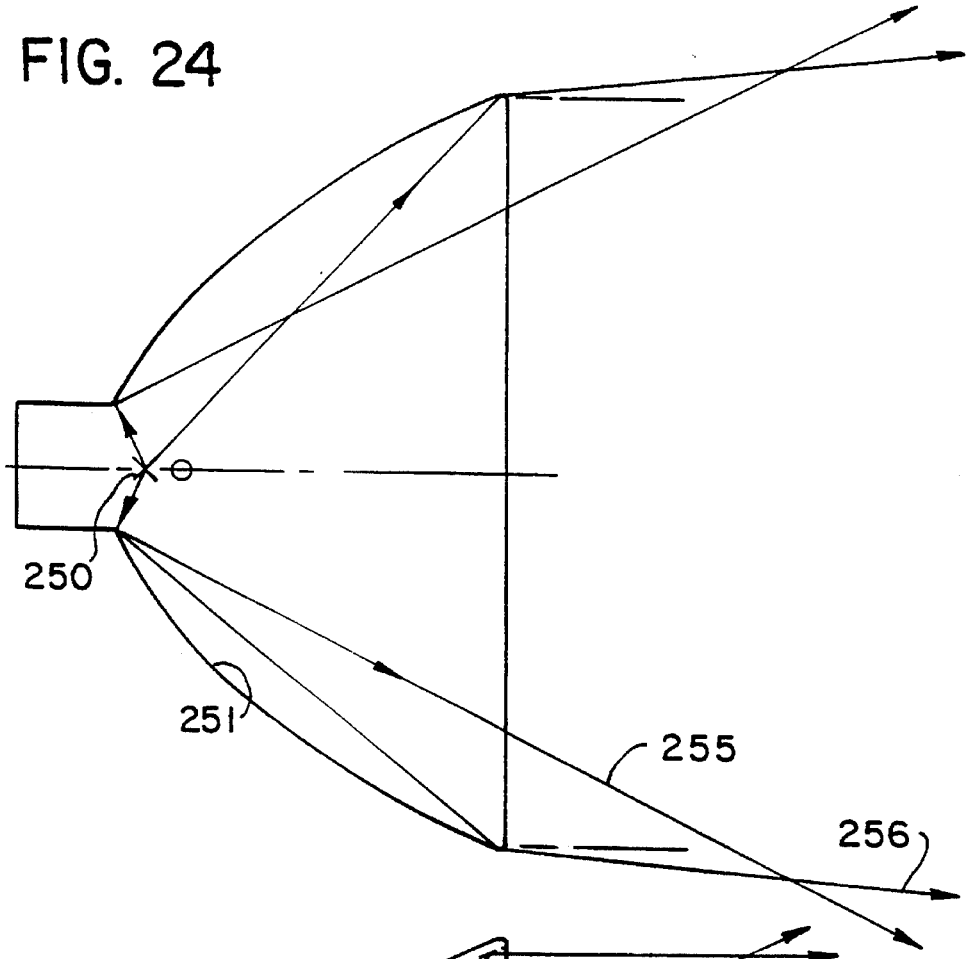
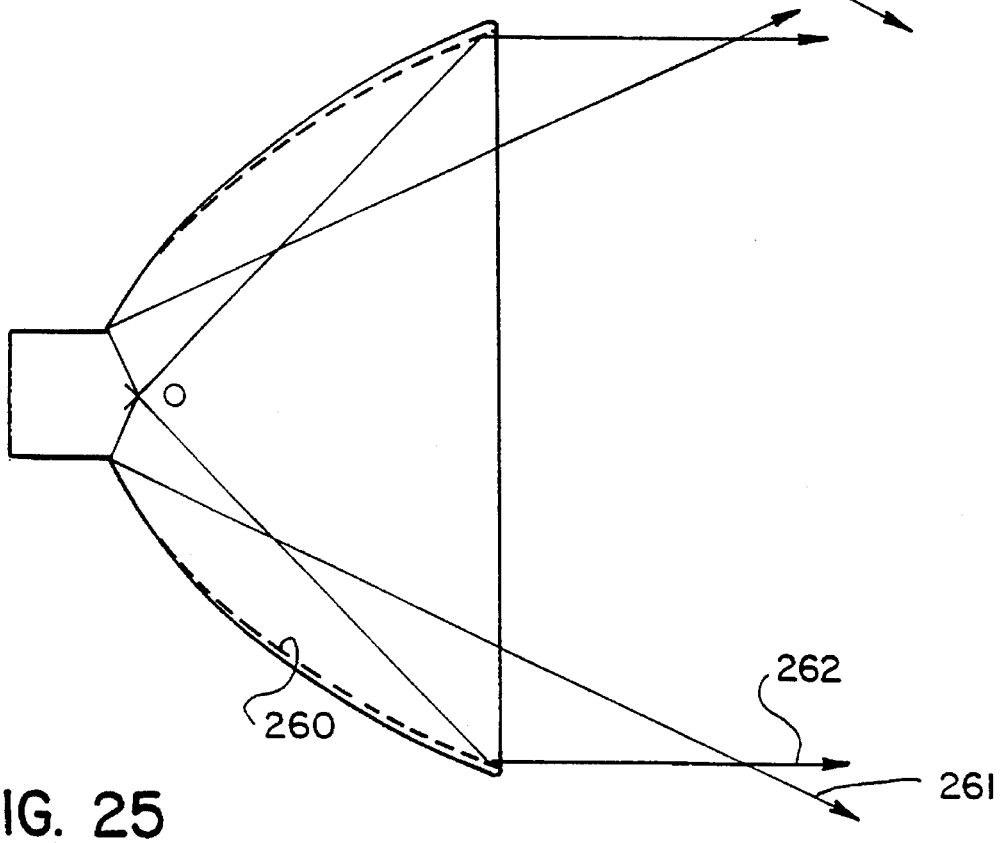
FIG. 25

FIG. 26
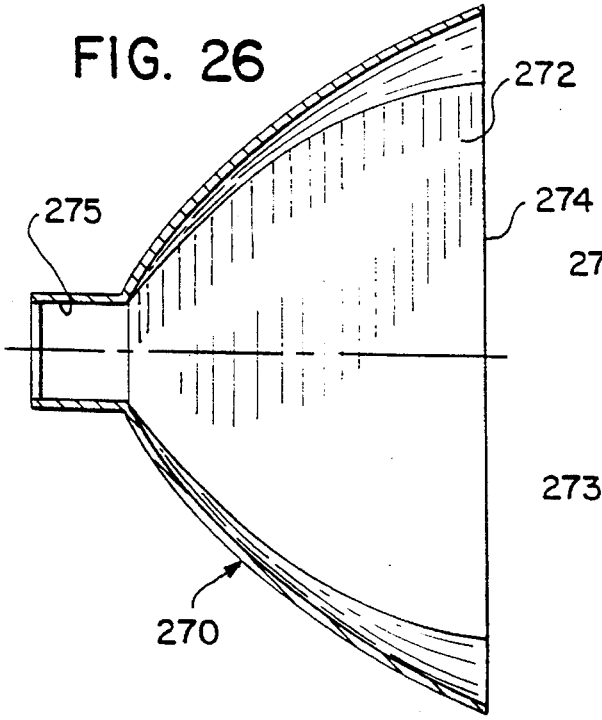
FIG. 27
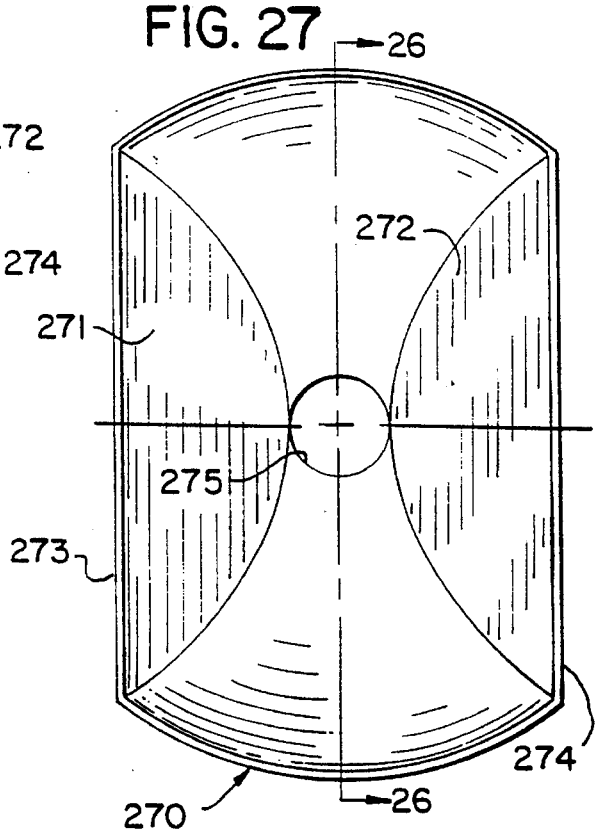
FIG.28
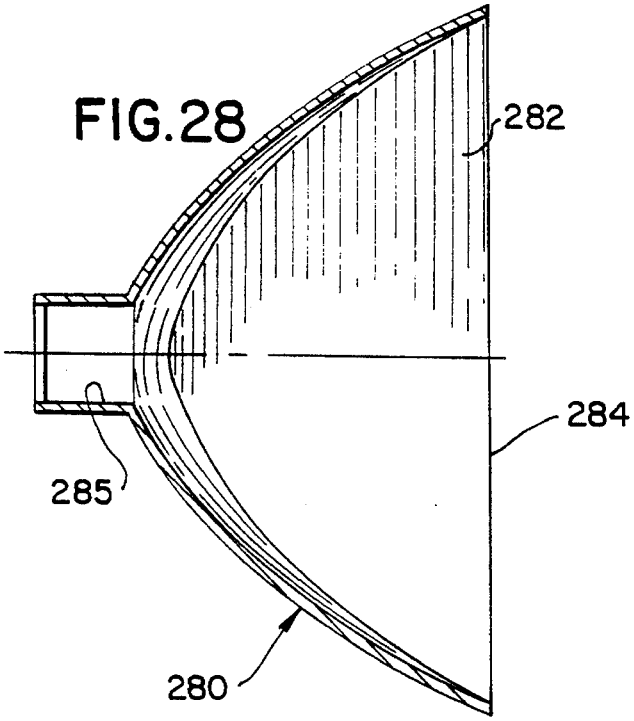
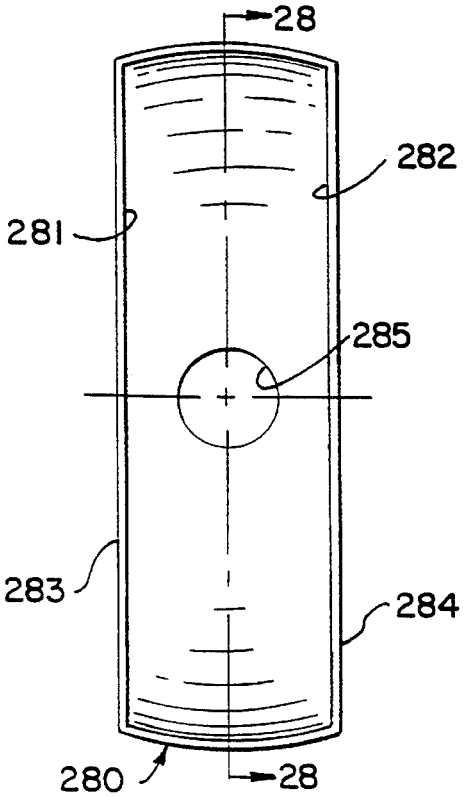
FIG. 29

FLASHLIGHT WITH AN ENHANCED SPOT BEAM AND A FULLY ILLUMINATED BROAD BEAM

CROSS REFERENCE TO OTHER APPLICATIONS

This is a continuation-in-part of applications Ser. No. 07/685,086 filed Apr. 10, 1991, entitled "ADJUSTABLE BEAM FLASHLIGHT WITHOUT NON-ILLUMINATED BEAM REGION AREAS", now abandoned, and Ser. No. 07/951,184 filed Sep. 28, 1992, entitled "ADJUSTABLE BEAM FLASHLIGHT WITHOUT NON-ILLUMINATED BEAM REGION AREAS", now abandoned.

FIELD OF THE INVENTION

This invention is a flashlight which can selectively project either a spot beam, or a broad beam that has no unilluminated regions, and which can be adjusted to reduce distortions which result from bulb filaments that are off of the axis of the flashlight's reflector.

BACKGROUND OF THE INVENTION

Persons, when in dark areas that are not provided with lighting installations, or if these are provided, then when there is a power failure, or in circumstances where the individual prefers not to turn on the lights, feel the need for a portable light-weight light source for localized illumination. With it, they can illuminate areas of concern for their own protection and guidance. The response to this requirement is the common flashlight or the directed-beam lantern.

The most common flashlight is designed to provide a focused or small area beam, commonly called a "spot" beam. This is intended to be a relatively high-intensity beam with a limited area of illumination. Its preferred pattern, at least at its center, is a circular disc of reasonably uniform intensity. Another common objective is to provide a broader beam, that is, a beam with a larger illuminated disc. For the same luminous output from the light source, its intensity will be less than that of the smaller-area spot beam by the ratio of the two areas.

For an ideal point light source, it is possible, of course, to design a reflector to produce a beam of any given desired diameter which is collimated and consequently does not increase with distance to the illuminated area. However, this requires a reflector configuration respective to each beam size. Furthermore, the parameters of such a reflector require an increasingly larger reflector as the diameter of the focused beam increases. These reflectors would be paraboloids of varying sizes. This requirement for larger size reflectors in order to produce larger size beams is a serious design limitation. In response, reflectors of various configurations have been suggested to produce broader beams with smaller reflectors by displacing the light source along the axis of the paraboloid. Still, the consequence of such designs has been a unique pattern at some established distance. At different distances, the pattern has undesirable variations and distortions since the reflected light rays are not parallel to the axis of the reflector. In general, such variations are often characterized by dark regions in the areas of the beam of greatest interest to the user.

One further limitation of the conventional flashlight prevents the formation of an "ideal" spot beam that has the same diameter as the maximum diameter of the reflector. Conventional flashlights employ a polished surface paraboloidal reflector with a hole at the apex to accommodate the light bulb and bulb support structure. The result of having no reflecting surface near the centerline of the reflector is an unilluminated center disc when the point light source is positioned at the focus of the paraboloid. In order to illuminate the center area, the light source must be moved off of the focus and consequently produces a spot beam that has a larger diameter than the axis or diameter of the reflector.

There remains to be provided a flashlight which can selectively produce, with a relatively small reflector, both a small spot beam and a larger area broad beam, with a reasonably constant luminosity across the beam in both beam configurations over a substantial range of distances. It is an object of this invention to provide such a flashlight.

It should be kept in mind that the common flashlight has an incandescent filament and a concave reflector. Light emitted by the filament exits the flashlight in two modes. One mode is that of radiantly-emitted light without reflection. The reflector has an aperture which serves as a cut-off for this direct radiant illumination, and this light is emitted generally as a cone, and provides general low-level illumination, even outside of a central area yet to be described. The intensity of this direct radiated light decreases very rapidly at distance from the bulb because it is not collimated or controlled as is the reflected light. While substantial, the "conical volume" of this illumination from the filament is considerably less than the reflectively projected light which is reflected by the reflector in a designed, directed, pattern. It is the reflected projected light which provides almost all of the useful illumination from the flashlight. This useful illumination is the combination of light from the filament which goes reversely to the reflector, and also light which goes forwardly and still meets the reflector.

It is an object of this invention to provide a reflector which can project the light in either a spot beam or in a broad beam, both of which beams will be without substantial unilluminated areas over a substantial range of distances. It is a matter of great frustration with a conventional flashlight to find that, in the broad beam setting, the area of greatest interest is also that of darker or little illumination.

There is yet another problem with the common flashlight. Conventional reflector design is based upon the concept of a point source of light, and a focal point of a reflecting surface of revolution, usually a paraboloid. This is good theoretical geometry, and flashlights designed this way are sold by the millions. The imperfections of their projected light patterns have been overlooked in the absence of a better alternative.

The major problem in designing a flashlight which can produce both a spot beam and a broad beam is that the spot beam is best provided by a parabolic reflector with the light source close to the focus of the paraboloid. In order to broaden the beam, the light source is moved further away from the focus. This movement, depending upon its magnitude and the distance between the flashlight and the illuminated area, results in distortions such as unilluminated regions, usually in regions of greatest interest.

Conventional reflector design generally ignores these variations, sometimes by changing some areas of the reflector from a smooth surface of revolution to ones which include small discrete flat surfaces, or to an "orange peel" texture. These alterations serve largely to disguise the shortcomings of the reflector by scattering or diffusing some of the light. This is done at the trade-off cost of reducing the intensity of the light where it is needed the most.

Another major problem which is generally overlooked is that the filament of the conventional light bulb is not a point source. Instead, it is a curved line source, and therefore cannot be a point source anywhere. Even worse, not only must it inherently extend laterally from the central axis of the reflector, but due to variations in manufacture, no part of it at all may actually be on the central axis. Because the dimensions of the usual reflector are relatively small, even very small excursions of the filament from the central axis result in substantial deformations of the projected light pattern. In fact, in typical flashlights, a shift of only 0.1 inches along the axis is required to change from spot beam to broad beam, and even smaller ones in radial directions result in substantial distortions of the projected pattern.

The conventional adjustable or fixed beam flashlight has a flashlight axis related to a support such as its handle. Usually there is a method to align both the bulb axis and the reflector axis to the flashlight axis. The classical solution is to provide registry surfaces to hold both the bulb and the reflector in line as a single adjustment so they cannot be moved radially or angularly from the registered position. If the conformation of the bulb and of the reflector relative to the registry surfaces are both exact, all is well. However, this is rarely the situation. This is because the light bulbs used in these flashlights have a filament, usually a coil with a finite length, some or all of which is certain to be disposed off of the axis of the bulb, and if it is, then it certainly will be off of the axis of the reflector. The result is that although the bulb axis and the reflector axis are aligned, the filament is misaligned. The registry surfaces prevent any adjustment either radially or angularly. As a result of the filaments being off of the reflector axis and of having a finite size, the conventional paraboloidal reflector produces a spot beam that is irregularly shaped and has dimensions considerably larger than the maximum diameter of the reflector. The result is a duller spot beam than an ideal spot beam of smaller size. In addition, the adjustable beam flashlight with a paraboloidal reflector will produce a broad beam with an illuminated ring of light surrounding an unilluminated center disc precisely where the flashlight is aiming and in the region of greatest interest. These faults and the methods to overcome them will be made clear by the teachings of this patent.

It is an object of this invention to provide means to improve the distribution of reflectively projected light by adjustably positioning the filament in a uniquely contoured reflector.

SUMMARY OF THE INVENTION

This invention incorporates a reflector which can provide either a spot beam or a broad beam. In some applications it will be enabled to provide both selectively by axially shifting the reflector and the light source relative to one another.

The reflector has a concave reflecting surface in which a light source is positioned. The reflecting surface is a modified paraboloid, modified from a reference paraboloid with respect to the same focus. When a spot beam is to be projected, the light source is placed at the focus. When a broad beam is to be projected, the light source is shifted axially from the focus, preferably but not necessarily toward the larger end of the paraboloid.

The paraboloid is modified so as gradually to shift the rays which form the inner boundary of the broad beam so as to spread across the central axis of the reflector at a desired range of projection, thereby to fill in a central region of the projected pattern which otherwise would not be illuminated. Preferably, but not necessarily, at least some of these rays are parallel to the central axis, so as to remove the restriction on range.

According to a preferred but optional feature of the invention, means is provided to align the reflector and a specific light bulb relative to one another, so that at least a portion of the filament is disposed on the central axis, preferably its central part.

The above and other features of this invention will be fully understood from the following detailed description and the accompanying drawings, in which:

BRIEF DESCRIPTION OF THE DRAWINGS

FIGS. 9 and 10 are schematic illustrations of the mathematics involved in the arrangement of FIG. 6;

FIG. 11 is an illustration of the distortion of the projected pattern caused by a finite length filament light source;

FIG. 12 is a schematic cross-section illustrating the preferred modification of a true paraboloid for purposes of this invention; when the light source is shifted from focus toward the larger end.

FIG. 13 is an illustration of the mathematics involved in the modification of FIG. 12;

FIG. 14 is a semi-schematic axial cross-section showing adjustment means according to the invention;

FIG. 15 shows the angularly adjustment means;

FIG. 24 is a schematic axial cross-section of a true paraboloid, with the light source shifted from the focus toward the narrower end of the reflector; and FIG. 25 shows the path of light rays from a modified parabola, modified to accommodate a shift of the light source from the focus towards the narrower end.

FIGS. 26–29 are illustrations of an embodiment having planar reflecting surfaces.

DETAILED DESCRIPTION OF THE INVENTION

In considering this flashlight, it should be kept in mind that its ultimate objective is to produce a spot beam or a broad beam, both of which have substantial illumination across their projected patterns over a wide range of distances from the reflector to the target surface. It is suitable for use only to provide a good spot beam, and for use only to provide a broad beam. It can also be used to provide both such beams selectively.

Before the description of this unique reflector can be understood, it will be necessary to develop several geometric relations for the reflectively projected light rays that are emitted by an incandescent light bulb which has a finite size filament and that may or may not be on the axis of the bulb, and which may or may not be located axially at the focal point of the reflector.

Figure 1:
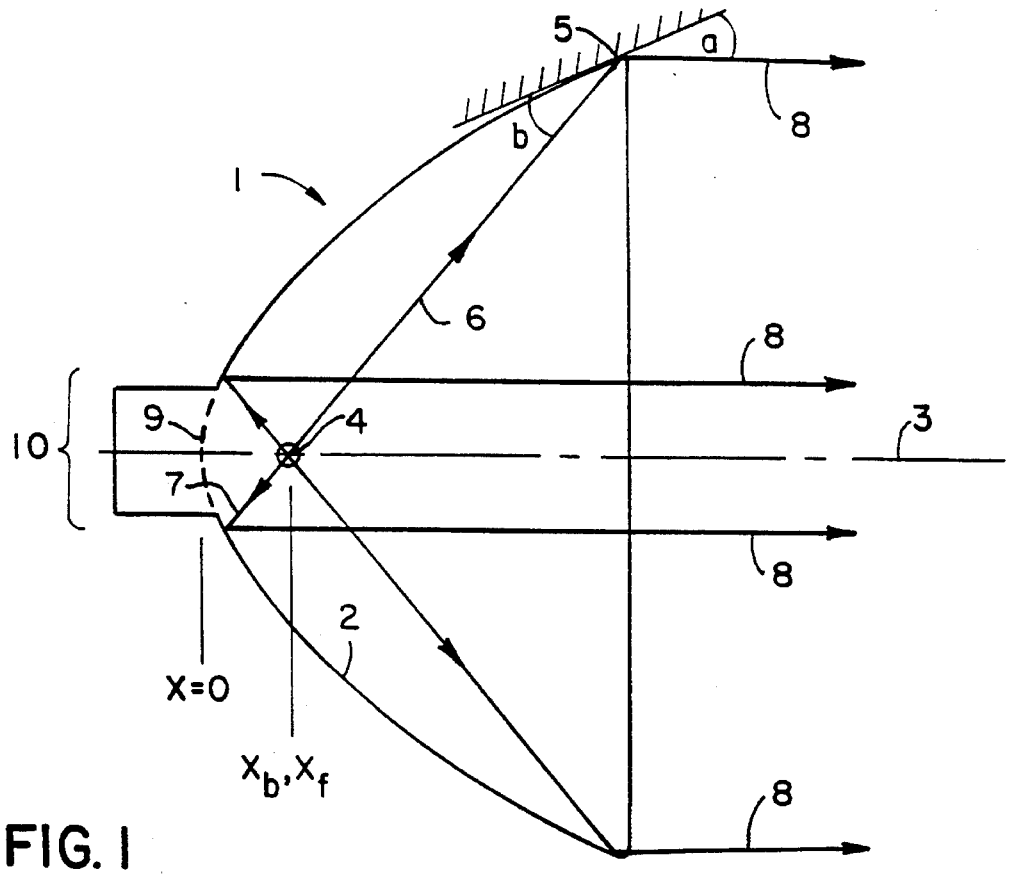
FIG. 1 is a schematic axial cross-section of a true parabolic reflector with a point light source as its focus.

As a starting point, consider a light source that is concentrated at a single point as illustrated in FIG. 1. FIG. 1 is a cross-section through the axis of a reflector 1 showing a two dimensional planar parabola 2 in place of the paraboloid that is actually used for a flashlight reflector. The conventional reflector is a paraboloid that is formed by the rotation of the parabola 2 about the axis 3. The parabola is defined by the relations $R^2=2px$ where R is the radial distance perpendicular from the axis 3 to the surface 2, p is a constant that determines the size of the parabola, and x is the distance measured along the axis 3 from the apex 9 of the parabola 2.

The light source will be treated first as a point source in order to simplify the teachings of this patent. In later discussions, a filament of finite size, positioned both on and off of the bulb axis will be treated.

As is illustrated in FIG. 1, all of the rays that originate from the bulb which is shown as a point source 4, when they meet the reflector, will be reflected spectrally from the surface 2 at an angle "a" that equals the angle of incidence "b". The angles "a" and "b" are measured from the tangent 5 at any point on the surface 2. The location of the light source 4 along the axis 3 is given as $x_b$. The location of the focus of the parabola is given as $x_f$. The location of the light source is indicated by "0" when at the focus and by "X" when located at any other point on the axis.

FIG. 1 illustrates, as an example, the tangent 5 located at the maximum diameter of the reflector and the light bulb 4 as a point source of light "0" that is consequently located at the focus where $x_b=x_f$. The direction of the light rays 6 from the source 4 that are directed towards the maximum diameter of the reflector will be referred to as the forward direction. The direction of the light rays 7 that are emitted from the light source 4 towards the minimum diameter of the reflector will be referred to as the backward direction. This portion of the discussion treats only light which is reflectively projected, both forwardly and rearwardly. Radiantly emitted light which passes through the aperture without reflection, is treated separately since it produces a negligible amount of the useful illumination.

As is illustrated in FIG. 1, if the light source 4 is a point and is located at the focus $x_f$ of the paraboloid, all of the reflected rays 8 will emerge parallel to the axis 3. The fact that the light rays are reflected parallel to the axis is well known when the light source is at the focus ($x_b=x_f$) of the paraboloid. This result can be seen by considering the geometry of the system illustrated in FIG. 1 and the fact that the angle of incidence "b" is equal to the angle of reflection "a". The detailed geometry to indicate the direction of the reflected light rays will be developed later in this discussion. This paraboloidal reflector with a point source at the focus would produce the "ideal" spot beam with all of the reflectively projected rays being parallel to the axis 3 and forming a beam whose maximum size is equal to the maximum diameter of the reflector.

There is an area 10 in FIG. 1 at the apex of the paraboloid that has no reflective surface. This is the opening that accommodates the light bulb. As a result, the spot beam that is formed from a point source that is located at the focus of the paraboloid will have an unilluminated center. The diameter of the unilluminated disc is approximately one-third of the maximum diameter of the beam for a typical flashlight. Although the light radiated in a forward direction from the bulb that does not strike the reflector will cover the center disc, it is spreading spherically and consequently has a very low intensity a short distance from the flashlight. In order to illuminate the center of the beam, the point source is sometimes moved slightly from the focus to cause the reflected light rays to cross the axis. The effect will be clear from the following teachings.

Figure 2:
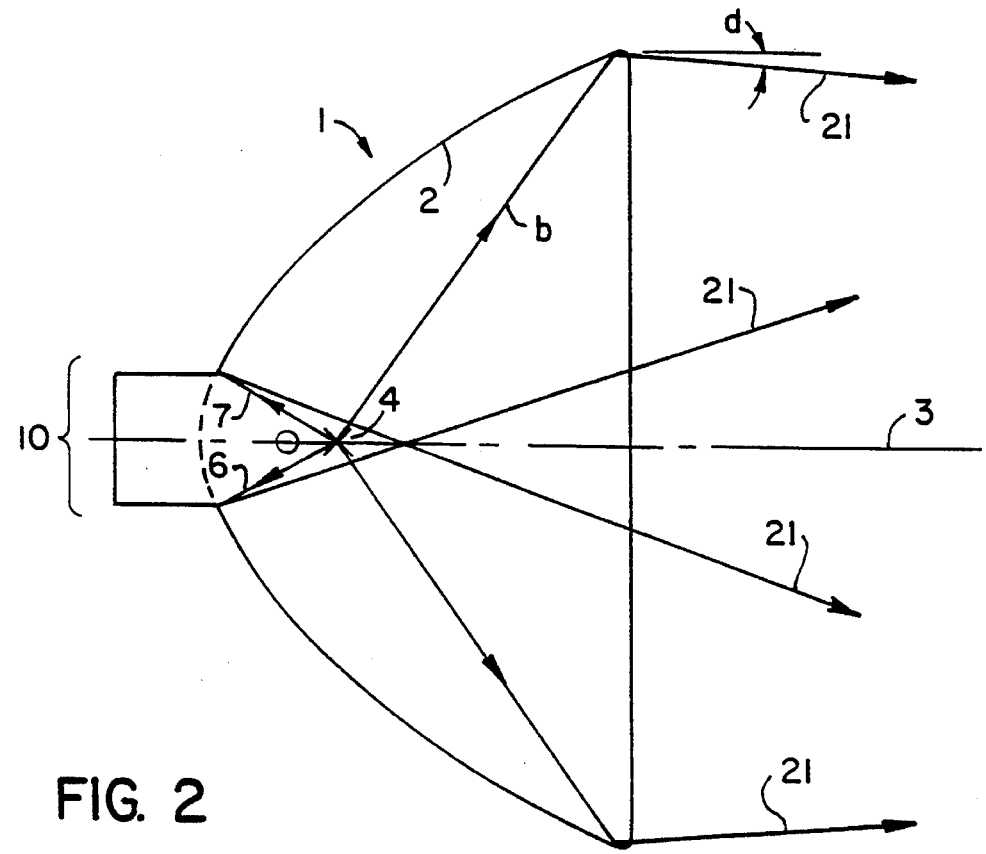
FIG. 2 is a schematic axial cross-section of the parabolic reflector of FIG. 1, with a point light source shifting axially away from the focus in the direction of the larger end of the reflector.

FIG. 2 illustrates the point source 4 displaced from the focus "O" of the parabola to a location "x" (x being greater than $x_f$) along the axis 3 in a forward direction in order to form a broad beam. For this condition, the light rays 6 and 7 will be reflected from the surface 2 at angles so that the projected rays 21 cross over the axis 3 and at some distance from the reflector spread out and form the broad beam.

It will be helpful in these teachings to develop at this time the geometric relations for the angles of the reflected light rays with a point source on the axis of the reflector.

Figures 3, 4, 5, 6:
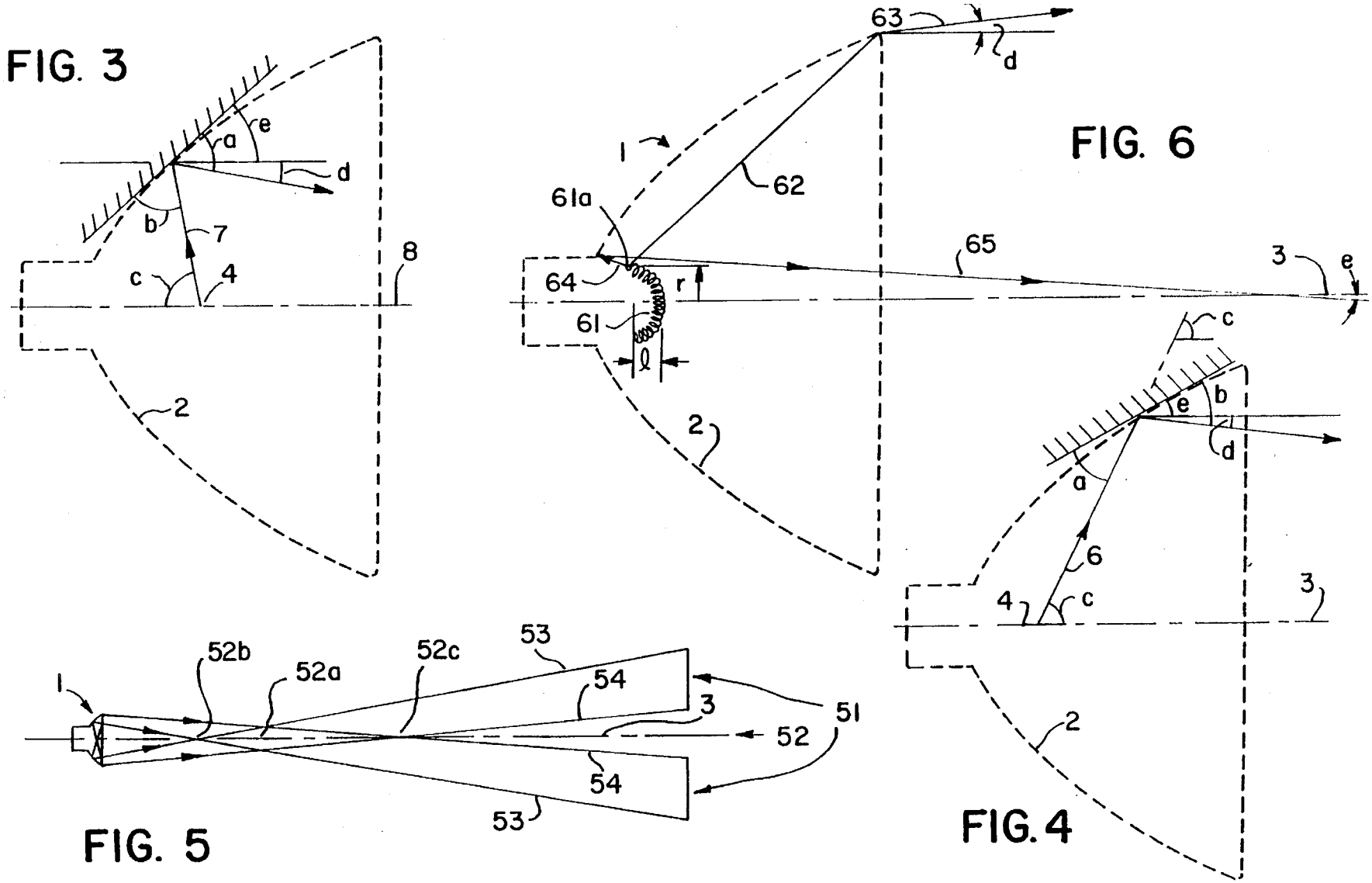
FIG. 3 is a schematic axial cross-section of the parabolic reflector of FIG. 1 demonstrating the mathematics of the geometry of the path of a light ray from a light source displaced from the focus as in FIG. 2, emitted toward the narrower end of the reflector.
FIG. 4 is the same arrangement as in FIG. 1, demonstrating the path of light rays emitted toward the larger end of the reflector, which intersect the reflector.
FIG. 5 is a schematic view in axial cross-section showing the regions illuminated by rays as illustrated in FIGS. 3 and 4.
FIG. 6 is a schematic axial cross-section of a true parabola, further illustrating the treatment of light emitted from the filament of a bulb, off of the central axis of the reflector, with no portion of the filament at the focus.

A general relation for the angle "d" in FIG. 2 when the point source is at any arbitrary location x on the axis 3 will be developed to aid in understanding this invention. Consider a point source of light 4 located on the axis 3 of the reflector as illustrated in FIG. 3. The light rays 7 that are emitted in a backward direction will reflect from the surface 2 at an angle relative to the axis 3 that equals (c+2e−180). This relation follows since the angle of incidence "b" equals the angle of reflection "a" and the following relations as seen from FIG. 3:

$$a=b \tag{1}$$

$$d=a-e \tag{2}$$

$$b+c+e=180° \tag{3}$$

It follows from equations (1), (2) and (3) that:

$$d=2e+c-180° \tag{4}$$

where "d" is positive, measured in the counter clockwise direction.

For light rays 6 that are emitted in the forward direction, the angle "d" that the reflectively projected rays form to the axis 3 is seen with the aid of FIG. 4.

$$a=b \tag{5}$$

$$b=c-e \tag{6}$$

$$a=e+d \tag{7}$$

It follows from equations (5), (6) and (7) that:

$$d=2e-c \tag{8}$$

The angle "d" is positive when measured in the counter clockwise direction from a parallel to the reflector axis. The angle "c" is the angle whose tangent equals (R/L) where L is equal to the difference between the values of x at the location of the point source "$x_b$" and the value of x at the location that the light ray reaches the parabolic surface 2 ($L=X-x_b$). The angle "e" is the slope of the parabola at any point relative to the axis 3. The value of the "e" is determined by the equation of the parabola, $R^2=2px$ and thus is the angle whose tangent is equal to dR/dx=p/R. It is seen that the angle that the forwardly reflected emitted rays form to the axis 3 are then defined as:

$$d = 2e - c \tag{8}$$

$$d = 2\arctan\left(\frac{P}{R}\right) - \arctan\frac{R}{x-x_b} \tag{9}$$

The angle that the backwardly emitted light rays form with the axis 3 are given as $$d = 2e + c - 180° \tag{4}$$

$$d = 2\arctan\frac{P}{R} + \arctan\frac{R}{x-x_b} - 180° \tag{10}$$

For the special case where the point light source is at the focus of the parabola (FIG. 1), the value of $x_b$ is equal to the location of the focus $x_f$ (i.e. $x_b=x_f=p/2$). For this case it is seen that d=0 degrees for any value of R and that the light rays are reflected parallel to the axis 3 and form the "ideal" spot beam whose diameter is the same size as the maximum diameter of the reflector but has an unilluminated center disc the size of the opening 10 to accommodate the bulb.

For the case where the point light source is located at any point on the axis between the focus and the maximum diameter of the parabola 2 the reflectively projected light rays cross over the axis 3 to form a broad beam. The magnitude of these cross over angles will be given later in this discussion with a numerical example for a typical adjustable (selectible) beam flashlight.

FIG. 5 illustrates how, when the point source is axially displaced from the focus, the light rays that are emitted from a point source are reflected so that they cross over the axis 3 of the reflector 1 to produce a ring of light 51. It should be noted that the entire center region 52 is not illuminated except at a region **52*a* which is located between cross-over points 52*b* and 52*c*, both of which are usually so close to the reflector as to provide a very narrow beam. The result is that the area of most interest to which the flashlight is pointing when a broad beam is desired is not illuminated. A broad beam of this type is generally formed from a conventional flashlight and is highly undesirable for reasons which will be appreciated from a study of FIG. 5**.

It will be shown later in this discussion by a numerical example that the rays 53 of light which illuminate the maximum diameter of the illuminated ring 51 are reflected from the minimum diameter of the reflector. The rays 54 of light that illuminate the minimum diameter of the illuminated ring 51 are reflected from the maximum diameter of the reflector. This is an important result to understand so that later discussions can teach how this invention can produce a broad beam with no unilluminated regions without also causing excessive enlargement of the size of the spot beam, and also without decreasing the brightness of the projected spot beam compared to the "ideal" spot beam, all over a substantial range of distances to the target.

Up to this time, the discussion has been limited to a theoretical condition where the light source is a point that is located precisely on the axis of the reflector. The light source for the conventional flashlight is not a point source, because it is an incandescent bulb that has a filament of finite size. An additional factor that contributes to the degradation of the spot beam is the manufacturing tolerances for the light bulb. These tolerances cause the filament to be located off of the axis of the bulb and, since the bulb is aligned to the reflector, the center of the filament will not be aligned on the axis of the reflector, and perhaps none of it is. Since the filament has a finite size and often all of it is located off of the axis of the reflector, it is impossible to obtain the "ideal" concentrated spot beam of the size of the reflector maximum diameter with the conventional flashlight. The magnitude of the degradation from an ideal spot beam with a point source compared to the actual spot beam with a finite size filament, and with an off-axis filament will now be presented.

First, a discussion of the effect of a finite size filament whose axis lies entirely in a plane with the reflector axis will be presented. This is the case for a perfectly aligned filament with its center on the reflector axis. FIG. 6 is a cross-section along the axis of the filament of a typical flashlight bulb having a filament 61 that is perfectly aligned with the reflector axis and extends a length "r" from the axis 3 and a distance "1" from the forwardmost part of the filament. The filament is enlarged in comparison to the reflector surface 2 in order to make the teachings of this patent easier to understand. The center of the filament is located at the focus of the reflector ($x_b=x_f$) and the two ends lie equal distances from the center. Since the center of the filament is at the focus, the light rays emitted from the center will be reflected from the surface 2 in a direction that is parallel to the reflector axis.

In FIG. 6 consider the light rays that are emitted by one extreme end of the filament in a plane that contains the axes of both the filament 61 and the reflector 2. Light ray 62 is emitted in a forwardly direction from the end **61*a* of the filament 61 to the maximum diameter of the parabola 2 (at its exit aperture). The reflected ray 63 is at an angle "d" from the axis. The light rays that are emitted in the plane containing the filament axis and the reflector axis 3 form an angle "d" relative to the axis 3** that has the same relation as equation (8) except that in this case the angle "d" is defined as the angle whose tangent equals (R-r)/L rather than (R/L). Thus the angle "d" is given by:

$$d = 2\arctan\frac{P}{R} - \arctan\frac{R-r}{L} \tag{11}$$

$$d = 2\arctan\frac{P}{R} - \arctan\frac{R-r}{x-x_b+l} \tag{12}$$

where $x_b$ is the location of the center of the filament on the reflector axis, r is the distance from the center of the filament radially to the end of the filament, 1 is the distance from the center of the filament to the end point measured parallel to the axis 3, and x is any axial position of the reflector surface

2.

In a similar fashion, the backwardly emitted rays 64 will be reflected at an angle "e" with the axis of the reflector equal to:

$$d = 2e + c - 180° \tag{4}$$

$$d = 2\arctan\frac{P}{R} + \arctan\frac{R-r}{x_b - x - l} - 180° \tag{13}$$

It has been shown that for the spot beam setting, the center of the filament is positioned at the focus of the paraboloid and all light rays that are emitted from the center point will be reflectively projected in a direction parallel to the reflector axis. It has been shown also that the light rays that are emitted from the end of the filament in a plane that contains both the reflector axis and filament axis will be reflected to form an angle "d" specified by equations (12) and (13).

Figure 7:
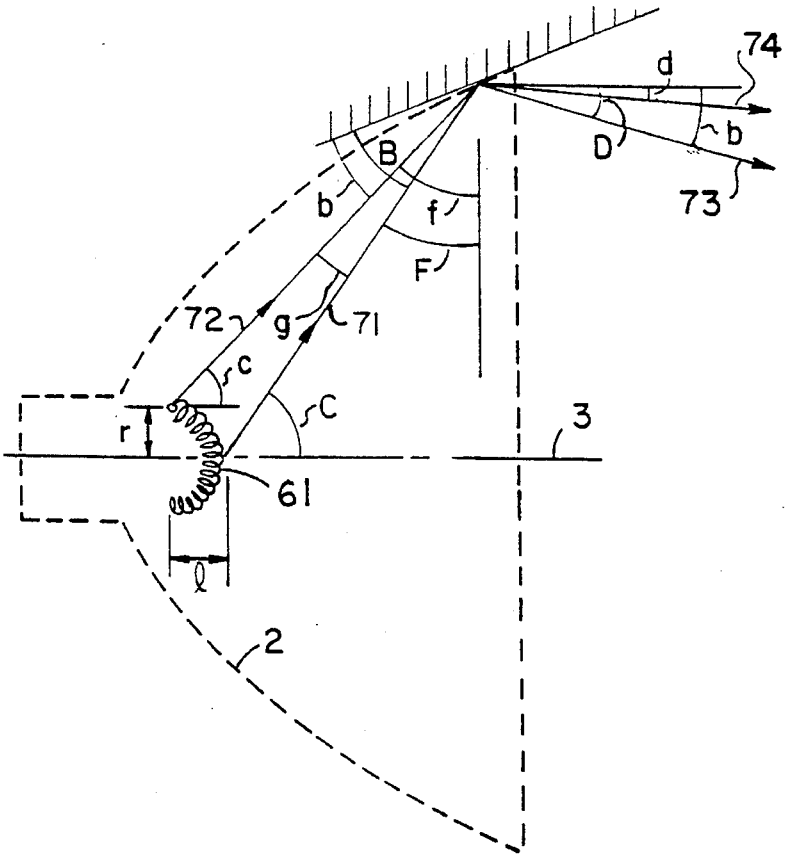
FIGS. 7 and 8 are schematic illustrations of the mathematics involved in the arrangement of FIG. 6.

It will be helpful in determining the angles of the light rays that are reflected in planes that do not contain both the reflector and filament axis to derive the relationships in a simpler fashion for the finite size filament. Refer to FIG. 7 where the angles of the rays emitted from the end of the filament are identified by lower case letters and those from the center of the filament by capital letters. A simplified relation can be derived when it is realized that the light rays emitted from the center of the filament will reach the reflector surface 2 at an angle "B" that is different from the angle b for the rays emitted from the end of the filament and that the difference equals the angle "g".

It is seen that the angle of the reflected ray 73 that originated from the center of the filament is "g" degrees more than the reflected ray 74 from the end of the filament. If the center of the filament is placed at the paraboloid focus, the angle "D" is zero and the reflected ray 74 has an angle equal to "g" measured parallel to the reflector axis.

It can be seen from FIG. 7 and equations (14) and (15) that the difference between the direction of the reflected rays 73 that were emitted from the center of the filament and reflected rays 74 from the end of the filament is equal to the difference between the angles C and c.

$$g=f-F \tag{14}$$

$$C+F=c+f \tag{15}$$

$$g=C-c \tag{16}$$

When the center of the filament is at the focus of the reflector D=0, and the rays 74 are reflected at angle "d" relative to the axis 3.

$$d = 2e - c \text{ and } D = 2e - C \tag{2}$$
$$\text{then } d - D = C - c = g \tag{17}$$

$$d = \arctan\frac{R}{x - x_f} - \arctan\frac{R-r}{x - x_f + l} \tag{18}$$

Figure 8:
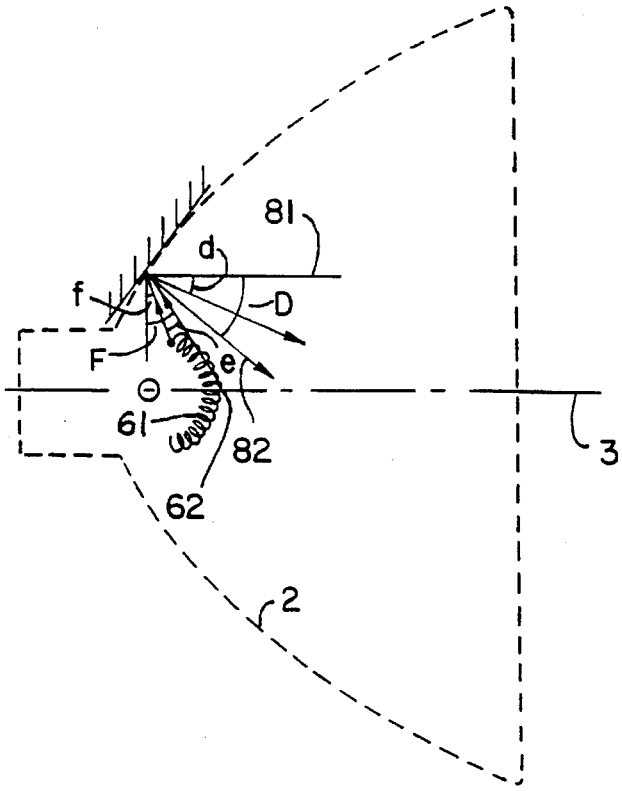

Similarly for the rays emitted in a backwardly direction, use of equation (17) with the help of FIG. 8 will provide the simplified relation for the angle of the reflected rays:

$$d - D = C - c \tag{17}$$

$$d = \arctan\frac{R}{x_b - x} - \arctan\frac{R-r}{x_b - x - l} \tag{19}$$

When the center of the filament is at the focus of the reflector D=O and the rays 81 are reflected parallel to the axis 3 and the rays 82 are reflected at an angle relative to the axis 3 of:

$$d = \arctan\frac{R}{x_f - x} - \arctan\frac{R-r}{x_f - x - l} \tag{20}$$

Up to this point in the discussion, only the light rays that are in the plane which includes both the filament axis and the reflector axis have been considered. In order to determine the size of the spot beam, however, it will be necessary to consider the light rays that are reflected in other planes. FIG. 9 illustrates the plane 91 that contains the reflector axis 3 and the filament 61 as well as the plane 92 that is perpendicular to the filament axis and contains the reflector axis, but not the filament axis.

If the center of the filament 61 is on the axis of the paraboloid, all of the rays emitted from that location will be reflected in planes that contain the reflector axis. The light that is emitted from other points on the filament will not be reflected in planes that contain the reflector axis except for the one plane 91 that contains both the filament axis and the reflector axis. This condition and others will be made clear by considering FIG. 9 which illustrates a cross-section of the paraboloidal reflector cut through the axes of the reflector and the filament (plane 91) and cut through a plane 92 which is perpendicular to plane 91.

It was shown by equations (16) and (17) that the difference between the angles of two rays reflected from any point on the reflector is equal to the difference between the angles that those rays make with the axis of the reflector from their points of emittance. For the case where the center of the filament is on the axis of the reflector at the location of the focus, the light rays 94 that are reflected from that point will emerge at an angle that is parallel to the axis 3. The light rays that are emitted from the end of the filament in plane 91 in a backward direction can be determined from equation (20). The light rays 93 that are emitted from the end of the filament to a point on the reflector 94 that lies in plane 92, can be seen from FIG. 9 to be at the angle:

$$d = \arctan\frac{(r^2 + l^2)^{1/2}}{[(x_f - x)^2 + R^2]^{1/2}} \tag{21}$$

It is interesting to notice that the reflected ray 93 is not in any plane that contains the reflector axis.

In a similar way, the rays that are reflectively projected in a forwardly direction in plane 92 can be evaluated with the aid of FIG. 10. Light ray 101 originated from the center of the filament which is at the focus of the paraboloid and consequently reflects in a direction that is parallel to the axis 3. Light ray 102 was emitted from the end of the filament and consequently has an angle relative to the axis as specified by equation (22). Reflected ray 102 is not in any plane that contains the reflector axis.

$$d = \arctan\frac{(r^2 + l^2)^{1/2}}{[r^2 + R^2 + (x - x_b - l)^2]^{1/2}} \tag{22}$$

The teachings of this patent will become clearer by a numerical example. Consider a typical D-cell size flashlight with a typical commercial light bulb. The typical reflector has a maximum radius that is equal to 0.93 inch, a minimum radius of 0.30 inch in order to accommodate the light bulb, and a length of the paraboloidal reflector measured from the apex of 1.25 inch. The surface of revolution can be represented as a parabola having the formula $R^2=2px$ where p=0.346 and having a focus located at $x_f p/2=0.173$ inch. The equation of the parabola that fits these conditions is $R^2=0.692x$. The typical light bulb has a filament that is 0.050 inch long (r=0.025) and whose ends are 0.010 inch from the center measured parallel to the reflector axis (1=0.010). For this light bulb that is assumed to be perfectly aligned with the axis of the reflector, the light rays in the plane of the filament and the reflector axes that were reflected from the minimum diameter will form a spot beam of a size determined by the angle:

$$d = 2\arctan\frac{r}{R} + \arctan\frac{R-r}{x_b - x - l} - 180° \quad (13)$$

$$= 2\arctan\frac{0.346}{0.302} + \arctan\frac{0.302-0.825}{0.173-0.133-0.101} - 180° \quad (23)$$

$$= 2\,(48.88) + 87.82 - 180° = 1.589° \quad (24)$$

The light rays in the plane perpendicular to the axis of the filament will diverge at a larger angle:

$$d = \arctan\frac{(r^2+l^2)^{1/2}}{[(x_f-x)^2+R^2]^{1/2}} \quad (21)$$

$$= \arctan\frac{[(0.025)^2+(0.010)^2]^{1/2}}{[(0.173-0.133)^2+(0.302)^2]^{1/2}} = 5.047° \quad (25)$$

The rays in any other plane between planes 91 and 92 will diverge at smaller angles and need not be considered in determining the size of the spot beam.

If the light source was a point located at the focus of the paraboloid, the spot beam would have an unilluminated center disc of 0.30 inch radius. However, because of the finite length of the filament, the spot beam illustrated in FIG. 11 is deformed to produce a non-uniform pattern 110 of illumination that covers the center disc. The spot beam that is formed by this reflector and filament will have the size and shape shown in FIG. 11. At a distance of 20 feet, the spot beam will be:

Width = 2(20) tan 1.589 = 1.11 feet
Height = 2(20) tan 5.047 = 3.51 feet
Approximate Area = (1.11) 3.51 = 3.9 sq. ft.

$$\text{Ideal Spot Beam} = \frac{\pi}{4}(0.932\times 2)^2$$

$$= 2.92 \text{ sq. inches} = 0.01887 \text{ sq. ft.}$$

It is soon that the "typical" flashlight with the "typical" filament will produce a spot beam at a 20 foot distance that is over 175 times the size of the "ideal" spot beam and consequently will be 1/175 times as bright. It should be noted that the light rays that form the outer contour of the spot beam are reflected from the minimum diameter of the reflector. Since the maximum diameter surface of the reflector has rays that diverge only approximately one degree at the spot beam setting while the minimum diameter reflects rays at far greater angles, the slope of the maximum diameter surface could be increased without degrading the spot beam. This conclusion will be employed in designing the new unique reflector contour according to this invention.

The other cause of the spread from the ideal spot beam is the result of manufacturing tolerances that result in placing the filament off of the axis of the bulb, or unsymmetrical to the axis. The spread because of a displacement off of the axis can be calculated from the same equations used for the filament of finite size. If the center of the filament is 0.050 inch off of the axis, the rays from that point in the plane of the filament will diverge at an angle of 1.61 degrees as determined by equation (13). The rays in the plane perpendicular to the axis of the filament will diverge at an angle of 9.37 degrees as determined by equation (21). In addition to these angles, the rays emitted from the ends of the filament will be reflected at even greater angles. It is clear that it would be highly desirable to eliminate this off of axis fault and consequently reduce the size of the spot beam and increase the intensity of illumination.

It has been shown that a finite size filament will produce a larger and consequently duller spot beam than the ideal spot beam from a point source. It has also been shown that the conventional flashlight does not correct for bulbs having a filament that is off of the axis and thus produces a larger and correspondingly duller spot beam than the ideal spot beam. It has also been shown that a paraboloidal reflector, even with a point light source, will produce a broad beam with an undesirable unilluminated center region. The spot beam from a point source at the focus also produces an unilluminated center disc, but it can be corrected by moving the source along the axis slightly away from the focus and consequently not degrade the spot beam very much.

It is possible at this point to describe the unique reflector that will overcome all of the faults of the typical available reflectors.

First, a description will be presented showing how the unilluminated center region in the broad beam can be corrected to result in a uniformly illuminated optimum broad beam without degrading the spot beam.

Equations (13) and (21) specify the angles that define the outline of the spot beam by the light rays that are reflectively projected from the minimum diameter of the reflector. Equations (12) and (22) specify the size of the spot beam by light rays that are reflected from the maximum diameter of the reflector. It was shown that some of the rays reflected from the minimum diameter form the outer region of the spot beam and that those that are reflected from the maximum diameter of the reflector form the center region when the point source is displaced from the focus. It was shown by equations (21) and (22) that the rays from the end of the filament that are reflected by the minimum diameter form a portion of the spot beam that is farther from the center than the rays that are reflected from the maximum diameter. The fact that the maximum diameter surface of the reflector can be modified without affecting the size of the spot beam is the genesis of this invention.

A numerical example will aid in the teachings of this specification. Consider the same conventional flashlight described previously. It was shown, and illustrated in FIG. 5, that the unilluminated center of the broad beam from a typical D-cell size flashlight is formed because the light rays that are reflected from the maximum diameter surface of the reflector will diverge from the parallel to the axis. The size of the unilluminated disc will be determined by the angles of the light rays that are emitted from the point of the filament that is located on the axis of the reflector and are reflected from the surface at the maximum diameter of the reflector. Equation (9) allows the angle of these rays to be calculated when the bulb is placed 0.100 inch forward of the focus ($x_b = X_f + 0.100 = 0.273$):

$$d = 2\arctan\left(\frac{P}{R}\right) - \arctan\frac{R}{x-x_b} \quad (9)$$

$$= 2\arctan\frac{0.346}{0.93} - \arctan\frac{0.93}{1.25-0.273}$$

$$= 2(20.405) - 43.59 = 2.78°$$

If the angle of the maximum diameter surface were increased by an amount equal to 2.78/2 degrees, the light rays would be reflected at an angle parallel to the reflector axis and would cause the rays to illuminate the center of the broad beam. It will now be shown based on the teachings of this patent that changing the slope of the maximum diameter surface will not result in an undesirable increase in the size of the spot beam, but instead will produce a desirable more pleasant uniform intensity spot beam.

It has been shown that the spot beam formed from the light rays that are reflected from the minimum diameter of the reflector will determine the size of the spot beam. For the typical D-cell size flashlight, the light rays that are emitted in the plane of the filament and the reflector axes diverge by 1.34 degrees (eq. 24) and those emitted in the plane perpendicular to the filament axis diverge by 5.08 degrees (eq. 25). These angles determine the size of the spot beam since the light rays that are emitted in any plane are reflected from the maximum diameter surface at much smaller angles.

Equation (12) determines that the spot beam that is formed by the rays which are reflected from the maximum diameter surface that were emitted in the plane of the filament and reflector axis have the value $$d = 2\arctan\frac{P}{R} - \arctan\frac{R-r}{x-x_b+l} = 2\arctan\frac{0.346}{0.93} - \arctan\frac{0.93-0.025}{1.25-0.173+0.010} = 1.030^\circ \quad (12)$$

Equation 22 determines that the light rays which are reflected from the maximum diameter surface that were emitted in the plane perpendicular to the filament axis would form a spot beam determined by:

$$d = \arctan\frac{(r^2+l^2)^{1/2}}{[(x-x_f)^2+R^2]^{1/2}} = \arctan\frac{[(0.025)^2+(0.010)^2]^1/2}{[(1.25-0.173)^2+(0.93)^2]^1/2} = 1.084^\circ \quad (22)$$

It is seen that the size of the spot beam which is formed from rays that are reflected from the maximum diameter surface is much smaller than the rays that are reflected from the minimum diameter (i.e. 1.030 degrees or 1.084 degrees compared to 1.589 degrees and 5.047 degrees). The reflected rays of all surfaces between the minimum and maximum diameters will diverge at angles between those from the extreme diameters.

It should be realized that, since the size of the spot beam is determined by the minimum diameter surface of the reflector, the slope of the maximum diameter surface can be increased somewhat without affecting the spot beam. In the example, if the slope of the maximum diameter surface were increased from p/R=0.346/0.93=0.372 (i.e. 20.41 degrees) to 0.400 (i.e. 21.80 degrees) the new surface would direct the light in a counter-clockwise direction by 2(21.80–20.41)= 2.78 degrees and, consequently, illuminate the center of the broad beam. This change in the slope at the maximum diameter of the reflector to redirect the reflected ray by 2.78 degrees when the bulb is at the broad beam setting, will also cause a redirection of 2.78 degrees when the bulb is at the spot beam setting. Since the spot beam is formed by light rays from this minimum diameter surface having an angle 1.589 degrees in the plane of the filament and 5.047 degrees for rays in the perpendicular plane, the light rays from the maximum diameter surface that are reflected at 2.78 degrees would not produce a larger spot beam. In fact, the slight spreading of the rays from the maximum diameter would form a more uniform intensity spot beam and thus a more pleasant appearing beam.

It has been shown that the slope of the maximum diameter surface of the reflector could be increased to illuminate the center of the broad beam without degrading the spot beam. It remains only to show how the minimum surface can be joined to the maximum surface in order to produce the optimum spot beam and broad beam.

One of the simplest configurations is described in Ellion U.S. Pat. No. 4,984,140 as a frusto-conical surface that is a tangent continuation of the paraboloid and having a half-angle equal to the desired slope that will illuminate the center of the broad beam. While the configuration of U.S. Pat. No. 4,984,140 is very functional, the inventor therein and also in this instant application has concluded that a superior configuration is possible that will produce an improved spot beam and a more uniform and pleasant broad beam having no unilluminated center.

FIG. 12 illustrates a conventional paraboloidal reflector 120. Shown in phantom is the unique reflector 121 according to this invention. The new reflector can be described as having a slope which at least equals that of the conventional paraboloidal reflector but which varies from it monotonically to the maximum diameter where it has a slope such that the light rays incident on it from the bulb are reflected in a parallel direction when at the broad beam setting. If the desired increase in the slope of the maximum diameter surface is given as "S" and since the slope of the conventional parabola is $dR/dx=p/R=(p/2x)^{1/2}$, one version of the desired reflector can be written as:

$$\frac{dR}{dx} = \left(\frac{P}{2x}\right)^{1/2} + S\frac{x-x_{min}}{x_{max}-x_{min}} \quad (26)$$

It is seen that the slope of the reflector will vary from that of a conventional paraboloid in a linear fashion to the desired slope at the surface of maximum diameter. Equation 26 can be integrated to give the equation of the desired linearly modified parabola.

$$R = (2px)^{1/2} - \left[\frac{Sx_{min}}{x_{max}-x_{min}}\right]x + \left[\frac{S}{2(x_{max}-x_{min})}\right]x^2 + \left[\frac{Sx^2\text{min}}{2(x_{max}-x_{min})} - (2px_{min})^{1/2} + R_{min}\right] \quad (27)$$

The general equation for the desired reflector will have the form:

$$R=AX^{1/2}+BX+CX^2+D \quad (28)$$

To ensure that the reflector is sufficiently long so that the rays which are reflected from the maximum diameter will illuminate the center of the broad beam, it is necessary to determine the maximum radius or the value of $x_{max}$. FIG. 13 illustrates the conventional parabolic reflector 132 with light ray 131 emitted from the center of the filament on the axis of the reflector and reflecting from the maximum diameter of the reflector. For the numerical case in the example, the reflected ray will have an angle of 2.78 degrees from the axis. It will be the intersection of this ray line with the new modified parabola 133 that will locate the maximum diameter of the modified parabola. The equation of the light ray is given by:

$$\frac{R}{x-x_b} = \frac{r_{max}}{x_{max}-x_b} \quad (30)$$

where the capital letters refer to the modified parabola and the lower case letters refer to the conventional parabola. For the typical D-cell size flashlight, equation 30 becomes:

$$R_{max}=0.9519X_{max}-0.2599 \quad (31)$$

The equation of the modified paraboloid in a convenient form can be obtained by integrating equation (26) from $R_{min}$ to $R_{max}$ to give:

$$R_{max} = (2px_{max})^{1/2} - (2px_{min})^{1/2} + S/2\,(x_{max}-x_{min}) - R_{min} = 0.832\,(x_{max})^{1/2} + 0.014x_{max} + 0.00186$$

$$R = 0.832X^{1/2} - 0.0031X + 0.01244X^2 - 0.001154 \quad (29)$$

The equations (29) and (31) when solved simultaneously yield the value of the maximum radius for the unique linearly modified parabola. In this case, a simple trial and error solution yields the values $R_{max}$=0.956 and $x_{max}$=1.278. It is seen that the linearly modified parabola is only slightly longer and has only a slightly greater diameter than the conventional reflector.

$$R_{max} - r_{max} = 0.956 - 0.93 = 0.0026 \text{ inch} \quad (32)$$
$$X_{max} - x_{max} = 1.28 - 1.25 = 0.030 \text{ inch}$$

A second integration for the desired increase in slope, S, is necessary since the length of the modified reflector is increased to 1.278 from 1.25 inches. Consequently, the desired increase in the ray angle (2.70 degrees) should be based on the conventional paraboloid length of 1.278. The slope at the maximum diameter of the conventional paraboloid is $p/R=P/(2px)^{1/2}=0.368$. Since we desire a surface slope of 21.8 degrees, the correct value of S is tan 21.8–0.368= 0.032. The equation of the modified paraboloid for the typical flashlight in the previous example becomes $$R=0.832x^{1/2}-0.00378x+0.1396x^2-0.000216 \quad (33)$$

In practice the reflector would be made slightly longer so that the light rays reflected from the extended section would further illuminate the center of the broad beam to produce a more pleasant effect.

There remains to demonstrate another unique feature of this reflector to correct for the location of a filament which is off of the axis of the bulb and, since the bulb structure and the reflector axis are generally aligned, will also be off of the reflector axis.

FIG. 14 illustrates in cross-section a filament 141 that is oriented angularly in the correct manner to the reflector axis 143 but whose axis 144 through the center of and perpendicular to the filament is off of the axis of a reflector. FIG. 14 also illustrates in cross-section reflector 146 with holes 142 that are larger than the diameter of the attachment bolts 143 so that the reflector can be positioned radially from the flashlight axis 145 as to position the filament axis 144 coincident to the reflector axis 145. When the reflector and the filament are properly aligned, the bolts are tightened in order to maintain that condition. Each time a new bulb is installed, the reflector should be repositioned.

FIG. 15 illustrates in cross-section a filament 153 with axis 152 that is misoriented relative to the axis 154 of a reflector 155. In this case reflector 155 has a set of other adjustable screws 151 that can correctly align the axis of the reflector 154 with the filament 152. FIG. 15 illustrates one technique for this alignment. Adjustment of screw 151 into the reflector and screw 151*a* out of the reflector will cause a rotation that will align the reflector and filament.

In adjusting the off axis filament or the misoriented filament, the reflector is moved until the flashlight produces the desired optimum spot beam. Either radial or angular adjustment can be provided, or both if preferred.

Selection of spot beam or of broad beam can be made by axially shifting either the bulb or the reflector, or both. Generally it will be preferred to move the reflector, because the position of the bulb will be related to the batteries. Mechanical means for shifting the reflection are shown in said U.S. Pat. No. 4,984,140, which is incorporated herein by reference for such a disclosure.

Figure 16C:
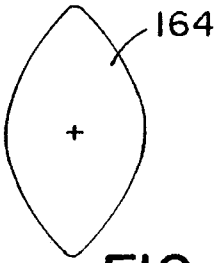
FIGS. 16*a*, 16*b*, and 16*c* are illustrations of distortions of the spot beam caused by off-axis arrangements, and the resulting improvement attainable with this invention.
Figure 16B:
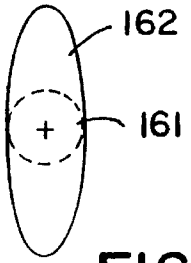
Figure 16A:
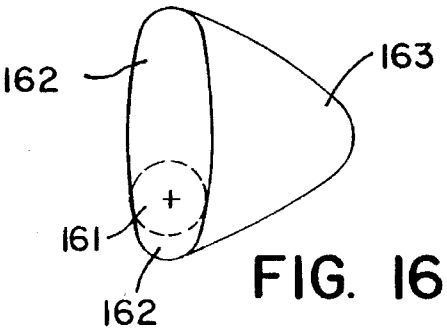

FIG. 16*a* illustrates the shape of a spot beam from a conventional paraboloidal reflector with a light source whose filament is off of the reflector axis. The various areas of illumination are shown in relative size for a D-cell flashlight whose filament is 0.050 inches long and is displaced from the axis by 0.050 inches in a direction perpendicular to the filament axis. The filament axis is in a vertical orientation for these figures. The "+" is the point at which the flashlight is pointing. Region 161 has the greatest intensity; region 162 is less bright; and region 163 is the dullest.

FIG. 16*b* illustrates the effect of aligning the filament according to this invention so that the center of the filament is on the axis of the reflector and at the focus.

FIG. 16*c* illustrates the spot beam with the filament aligned and its center on the axis of the modified paraboloidal reflector according to this invention. The spot beam is more uniform and of more pleasing shape.

Figure 17C:
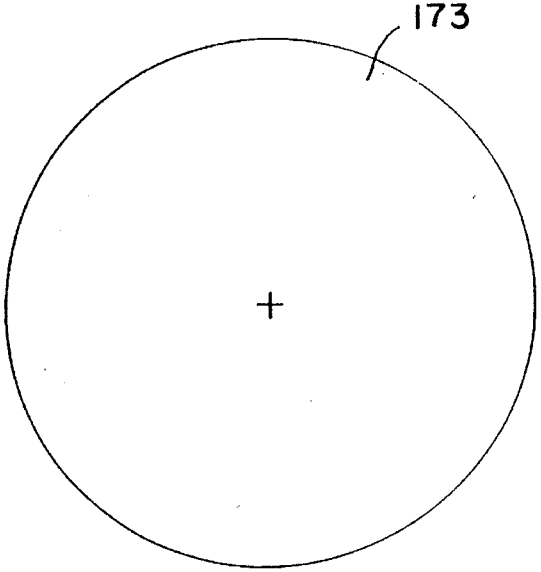
FIG. 17*a*, 17*b* and 17*c* are illustrations of the distortions of the broad beam by off axis arrangements, and the resulting improvement attainable with this invention.
Figure 17B:
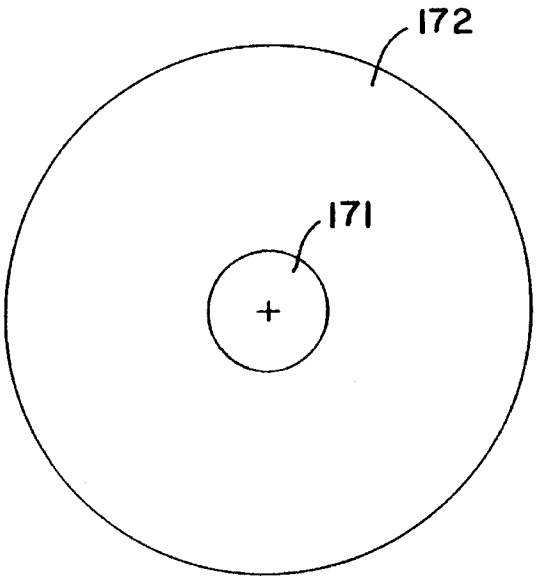
Figure 17A:
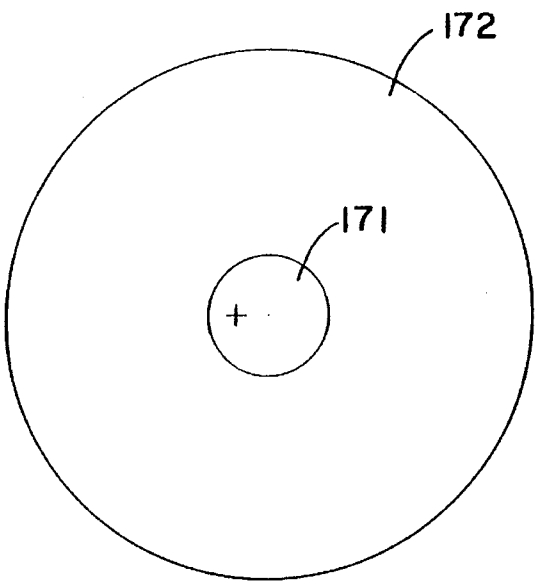

FIGS. 17*a*, 17*b*, and 17*c* show the same conditions as in FIGS. 16*a*, 16*b*, and 16*c* for the case where the lamp is displaced from the focus to form a broad beam. FIG. 17*a* is the conventional reflector with an outer illuminated rim 172 and the unilluminated spot 171 which is slightly displaced from the point at which the flashlight is pointing.

FIG. 17*b* has little effect on the broad beam other than moving the unilluminated center closer to the point at which the flashlight is pointing.

FIG. 17 illustrated the broad beam from the modified paraboloidal reflector according to this invention. It shows a fully illuminated broad beam. If the reflector were made slightly longer than the minimum required length, the center of the broad beam would have a brighter spot.

Figures 18, 19:
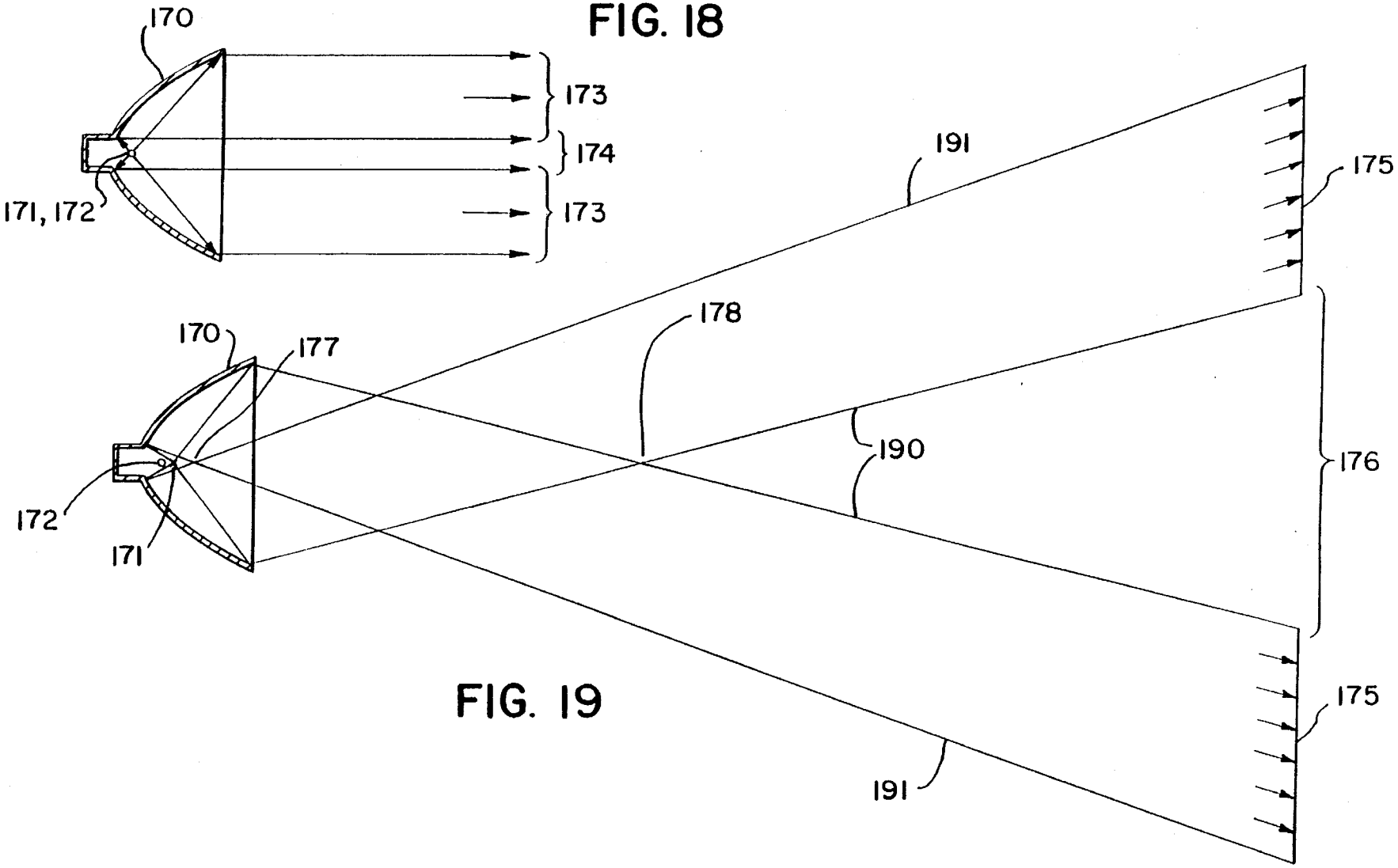
FIG. 18 is an axial cross-section of the projected rays from a true paraboloid with the light source at the focus.
FIG. 19 is an axial cross-section of the projected rays from a true paraboloid with the light source shifted from the focus toward the larger end of the reflector.

With the foregoing theoretical disclosure and the disclosed examples in mind, FIGS. 18–19 are presented to summarize the shortcomings of the prior art and the means by which this invention overcomes them. Again, the objective is to produce either a spot beam, or a broad beam, or selectively either one, in which the same reflector can produce either or both. In so doing, the spot beam will have at least the quality produced by known flashlights over a substantial range. Also the same reflector can produce a broad beam of substantially improved quality over a large range, compared with known flashlights. By quality is meant a projected pattern without dark spots or rings with reasonably uniform intensity over the illuminated area. In addition, when alignment means is provided between the lamp and the reflector, the projected pattern can be adjusted to be closer to circularity than is attainable with known flashlights, although in view of the linearity of the filament, it will tend toward an ellipse.

FIG. 18 shows a true parabolic reflector 170 reflecting light from a point source 171 at the focus 172 of the paraboloid. This beam is cylindrical, with a circular, cylindrical illuminated band 173, and a dark, unilluminated core 174. Since the light source is not a point, but rather is of finite length, the spot beam becomes fully illuminated but of larger and deformed shape than the ideal circular beam, the size of the maximum diameter of the reflector. The reflector according to this invention modifies this paraboloid so as to reflect light from the enlarged end into the dark region. The resulting beam will be larger than the theoretical spot beam, but will not have a central unilluminated area. As a matter of quality of projected spot beam, this quality is improved by its lack of a central dark spot, and the enlargement of the beam will scarcely be noticeable over the full intended range of distances.

FIG. 17 shows more graphically the same true parabolic reflector 170 with the point source 171 displaced from the focus 172. This is to generate a broad beam. The effect, as also shown in FIG. 5, is to generate an illuminated ring 175. A central circular dark region 176 is developed except between points 177 and 178 along the projection axis. Both of these points are too close to the flashlight to be of interest in the projection of a broad beam.

FIGS. 18 and 19 illustrate the serious shortcomings of the parabolic reflector, actually for either a spot beam or for a broad beam.

Figure 20:
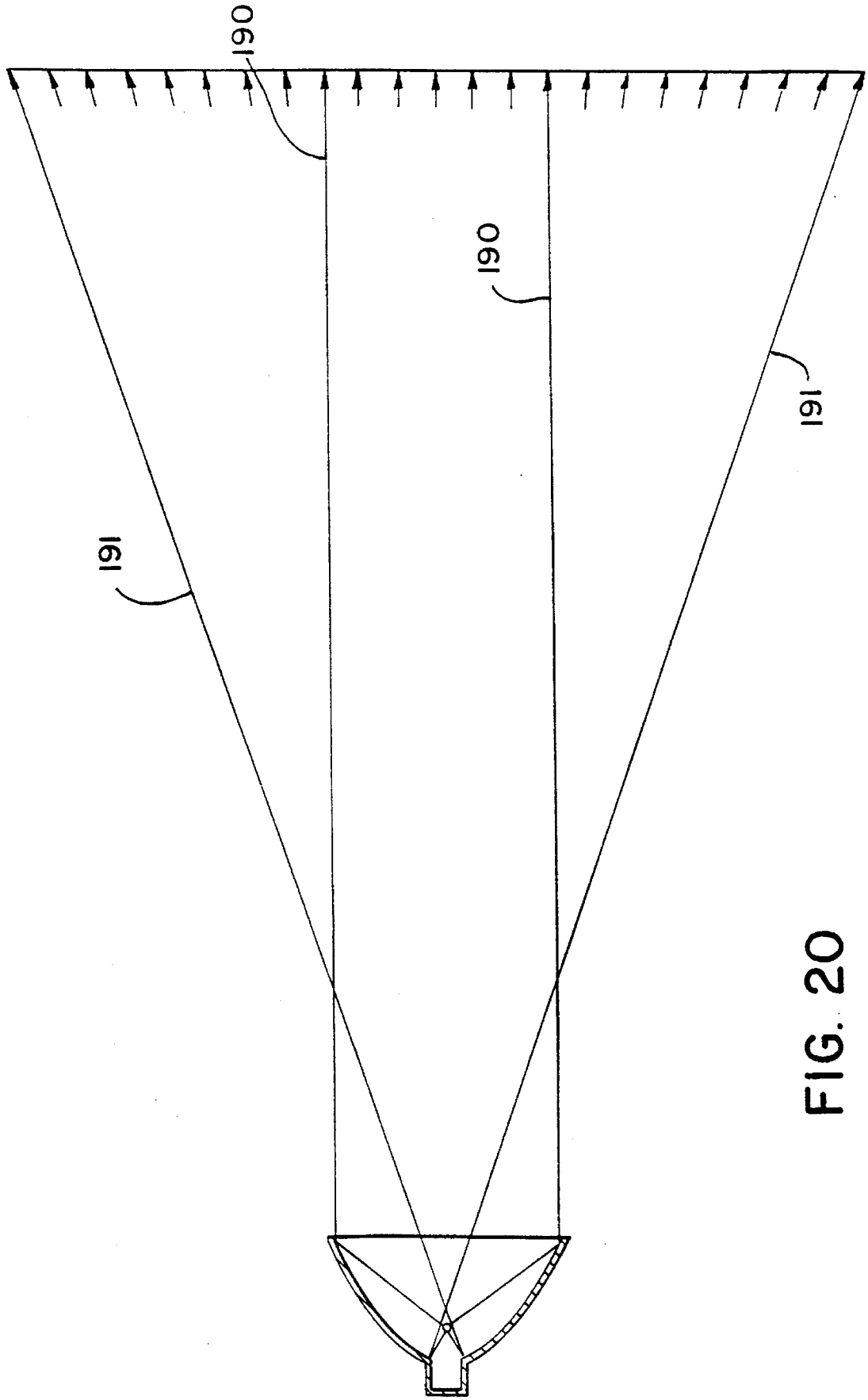
FIG. 20 is an axial cross-section of the projected rays from the modified paraboloid of this invention, with the light source shifted from the focus toward the larger end. This is the preferred arrangement.

Now compare FIG. 20. Again it should be noticed that the inside boundary of the projected ring, defined by ray 190 in FIG. 19 is reflected from the larger end of the reflector, and the outside boundary is defined by ray 191 in FIG. 19 reflected from the smaller end.

In FIG. 20, the included angle between the tangents to the reflector and the central axis have been gradually enlarged. This "brings" ray 190 toward and past the central axis, thereby spreading some of the illumination into what had been a central dark region. Gradually increasing this angle will gradually spread the illumination. As shown, ray 190 is parallel to the central axis, and regardless of the range there will never be a dark central region. The central region will in fact be brighter than a surrounding ring, but the pattern will be entirely illuminated, and will be brightest at the center, which is generally of greater interest.

FIG. 20 shows the preferred embodiment, in which ray 190 is parallel to the central axis. Then at any range there cannot be a dark central region. It is still within the scope of this invention to have ray 190 cross the axis at some significant distance beyond the intended range. The objective is to have rays 190, if not parallel to the axis, intersect it at a distance beyond the intended range.

Figure 22:
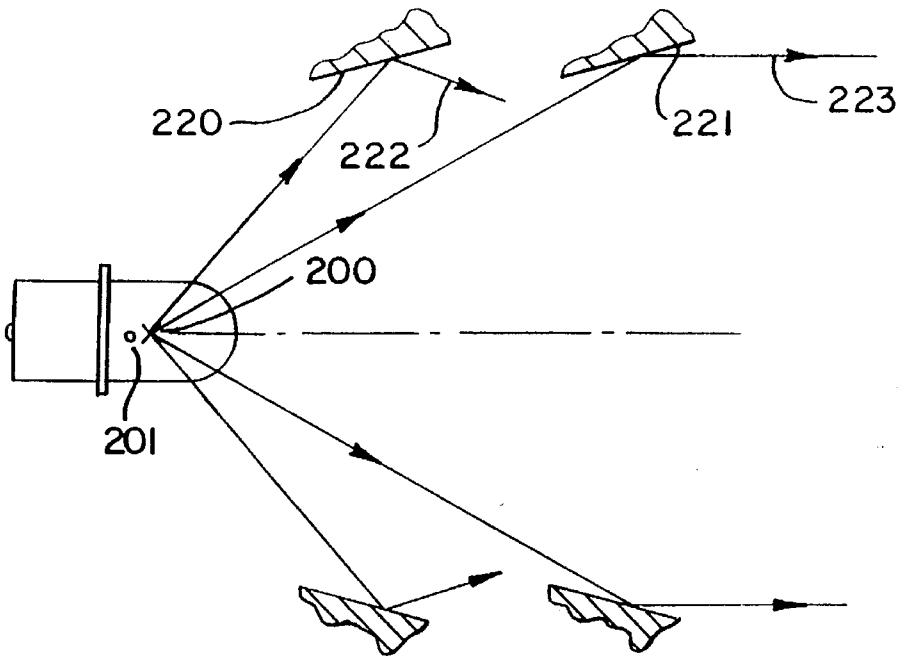
FIG. 22 shows the effects of a relative movement between an element of the reflecting surfaces and the light source.
Figure 21:
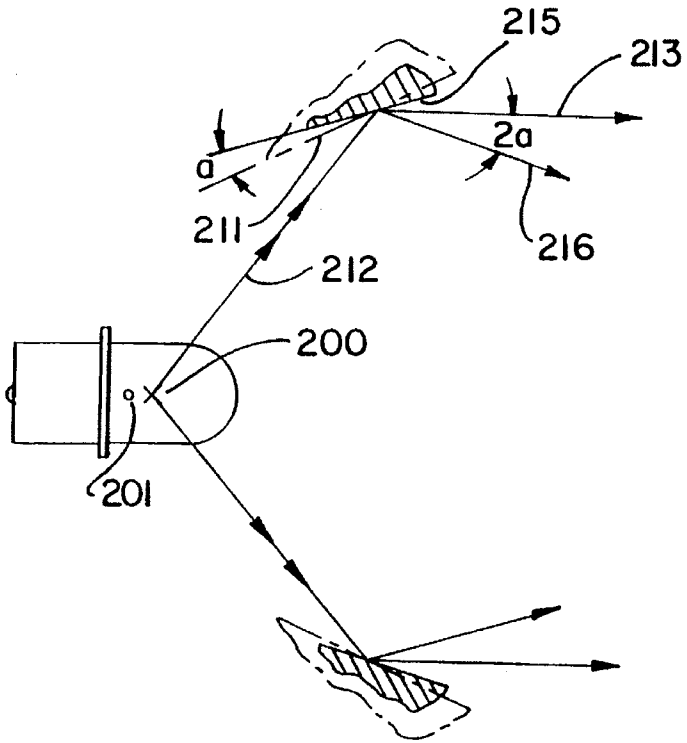
FIG. 21 shows the mathematical basis for different tangent angles at the reflector.

The criteria for modifying a true paraboloid in accordance with this invention are shown in FIGS. 21 and 22. A point source 200 of light is shown displaced from the focus 201 of the toward its larger end, which will generate the broad beam. A narrow region of the true paraboloid closely surrounding the aperture which receives the bulb is preferably maintained. This region contributes significantly to the illumination of a central portion of the projected spotbeam, although not right on the center.

Axially beyond that, the diameter of the reflector increases gradually, and the angle of its tangent relative to the central angle increases. This is for the purpose of spreading the broad beam light toward and past the central axis. The theory is demonstrated in FIGS. 21 and 22.

In FIG. 21, a reflecting tangent surface 215 is shown receiving a ray 212 and reflecting it as ray 216. Surface 215 will be treated as the true parabolic surface. Now assume that a new surface 211 is formed, with its tangent making an angle "a" with surface 215. This is the surface of the invention. The same ray 212 will be reflected as ray 213. The angle between them is "2*a*".

The effect is to tilt the reflected ray towards the central axis, and the gross effect of doing this continuously (or incrementally) along the reflector from the smaller to the larger end is to achieve the result shown in FIG. 20.

That this can be done is demonstrated in FIG. 22, in which axially spaced tangential surfaces 220, 221 are shown. Surface 220 is closer to the smaller end. Its reflected ray 222 will cross the central axis and illuminate a region farther out radially than ray 223 from surface 221. Of course, the tangent point of surface 220 will be closer to the tangent to a paraboloid then the tangent point to surface 221. FIG. 22 is intended to demonstrate the theory.

In practice, the reflector will be a modified paraboloid. The paraboloid to be modified is the one which will project a spot beam of the intended pattern diameter.

The paraboloid is modified by gradually increasing its diameter as it extends from the smaller end, while also gradually increasing the angle between the central axis and a tangent to the reflecting surface relative to the conventional paraboloid. The modification is such that, when a point source of light is shifted axially to form the broad beam, the reflector will have distributed light from the outside of the beam to a region at least coincident with the central axis (at a desired range), and preferably with one boundary parallel to the central axis.

The discussion to this point relates to forming a broad beam by moving the light source from the focus towards the larger diameter of the reflector. It is obvious that a broad beam could also be formed by moving the light source from the focus toward the smaller diameter. In this case the angle to the tangent to the modified paraboloid would be decreased as the diameter increases relative to the theoretical paraboloid.

In actual practice, in order to generate the broad beam, the light source will be shifted away from the focus toward the larger end. This is because the bulb fits in an opening in the reflector, and some light is emitted backwardly to the reflector and is projected forwardly. When the lamp moves forwardly, there is an increased spacing between it and the smaller end of the reflector. Then, despite the presence of the passage in the reflector, substantial light is reflected.

If the lamp is shifted toward the narrower end of the reflector, the advantages of this invention will still be attained, but to a lesser extent. This is because the lamp approaches the passage through the reflector, and will usually partially enter it. Considerable rearwardly-emitted light simply goes into the passage as a loss, and less light is available for distribution into the areas intended to be supplied by rearwardly-emitted light. Furthermore, the shape of the modified paraboloid, instead of enlarging from the theoretical shape, instead narrows.

This does serve to illustrate the versatility of this invention in providing reflector shapes which are modified either by enlargement from, or by reduction from, a basic, theoretical true paraboloid for the intended purposes.

FIGS. 24 and 25 show this situation. In FIG. 24, the movement of light source 250 toward the narrow end of a true parabolic reflector 251 relative to its focus 172 shows that in this broad beam arrangement, outer rays 255 are formed from the narrow end, and rays 256 from the larger end.

FIG. 25 in dotted line shows a reflector surface 260 according to the invention relative to reflector 260. In FIG. 25, the reflector surface is brought in, instead of out, continuously or incrementally. Notice ray 261, which is about the same as ray 255. However, ray 262 is moved inwardly. The rays between 261 and 262 fill in the target area.

It is not expected that the embodiment of FIGS. 24 and 25 will be commercially utilized, because of their sacrifice of light. However, their design criteria are the same as for reflectors in which the light source will be moved toward the larger end of the reflector.

The reflector described herein includes reflective regions for directing light as stated. It is possible to add on additional length to the reflector, and to utilize that additional length to direct or to diffuse light. Similarly, some areas which are the subject of this invention can be surface-modified, such as by orange-peel surfacing to provide a diffusion of light in some regions. This invention can accommodate such variations.

Figure 23:
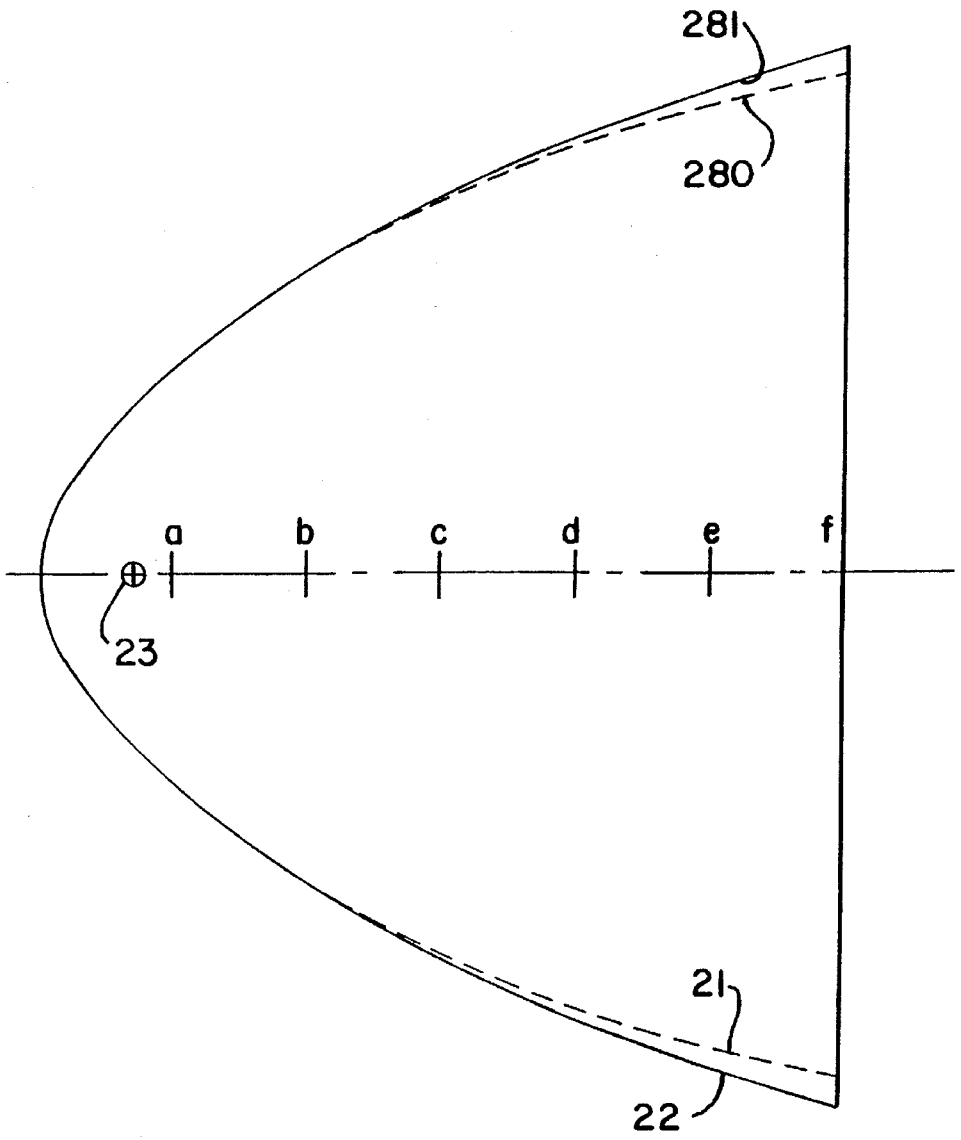
FIG. 23 is a dimensional reference for a table of values.

FIG. 23 illustrates a true parabola in phantom line 280 and a reflector 281 according to this invention. The true parabola has formula, $R^2=2px$, where R is the radial distance from the central axis to the reflective surface, x is the axial distance measured from the apex and p is chosen as 2.402 so that the difference between the two reflectors is visible. This table will enable a person skilled in the art to make a suitable reflector according to this invention. The dimensions are in inches.

| | | Radius | | Reflector Surface Angle | |
|---|---|---|---|---|---|
| Station | x | Parabola | Invention | Parabola | Invention |
| a. | 1.000 | 1.5498 | 1.5517 | 57.1694 | 57.2638 |
| b. | 2.000 | 2.1918 | 2.2027 | 46.6199 | 47.9443 |
| c. | 3.000 | 2.6844 | 2.7111 | 41.8222 | 42.4342 |
| d. | 4.000 | 3.0997 | 3.1492 | 37.7726 | 38.7022 |
| e. | 5.000 | 3.4655 | 3.5447 | 34.7265 | 35.9907 |
| f. | 6.000 | 3.7963 | 3.9121 | 32.3224 | 33.9317 |

The techniques for correcting for the off axis filament or the misoriented filament are not limited by these embodiments since persons skilled in the art could envision others such as moving the bulb rather than the reflector based on the teachings of this patent or other means of restraining the reflector relative to the filament after the adjustment.

The foregoing examples have disclosed complete surfaces of revolution, and if maximum light intensity in a controlled beam is the objective, then these are the shapes which should be used. However, the flashlight will then always have a larger end with a diameter considerably larger than the handle to which the reflector and lamp are mounted. This is quite conventional and is generally accepted. However, should one wish to carry the flashlight in his pocket or lay it down, a flatter reflector is to be preferred. This will, of course, reduce the area having the shape according to this invention but will produce either a spot beam or a broad beam of lesser intensity and modified shape, which is better than attainable with a similar modification of a true paraboloid. Further, the modified surfaces themselves can have reflective properties which will provide illumination, but not in the same controlled pattern.

For example, in FIGS. 26 and 27, a reflector 270 according to any of the foregoing examples has a dimension of width in one lateral axis at its larger end reduced by forming two planar reflecting faces 271, 272 extending from end edges 273, 274, respectively, to near adjacency to the center hole 275. It may or may not extend through the reflecting region immediately adjacent to the hole. These slanting faces will also reflect light, but not in the same controlled pattern as the remainder of the reflector, which still will produce beams without unilluminated regions.

Another example is shown in FIGS. 28 and 29, wherein a reflector 280 according to any of the foregoing examples (except that of FIGS. 26 and 27) has a dimension of width in one lateral axis at its larger end reduced by a pair of planar reflecting surfaces 281, 282 that extend parallel to the central axis away from end edges 283, 284, respectively. In this embodiment, the planar surfaces remain well spaced from the center hole 285. Again, these planar surfaces will reflect light, but not in the same controlled pattern as reflected by the remainder of the reflector.

In FIGS. 26–29, the flashlight has the advantage of thin-ness for being carried in a pocket or purse, and cannot roll away when laid down.

FIGS. 26–29 further indicate that the paraboloidal surface need not be a complete one in order to enjoy the benefits of this invention. Intermediate modified or omitted regions may provide advantages of their own, while that portion of the reflector which is at least a part of the modified paraboloid will provide these advantages, although delivering less light. Accordingly, the claims are not intended to be limited to reflectors which are complete modified paraboloids.

Also, the larger end of the modified paraboloid need not also be the larger end of the reflector. Extensions for various purposes such as light cut-off, or additional concentration of light in selected regions, or even for protection or retention of a lens, can be added on. Similarly, the modified paraboloid could also include bands of different shape should some "tailoring" of the beam be desired.

While this invention will find its greatest use in hand-held flashlights, and the specification and claims use this term, it can be scaled to any size, to include handle held small lamps and large searchlights. All of these and similar items are intended to be included in the term "flashlight". Also larger items will sometimes use arcs rather than filaments for a light source. All sources of light are to be included in the term "source".

In summary, this invention provides:

1. An improved flashlight which selectively provides a spot beam and a broad beam. The modified parabolic reflector produces with either a point source of light or an extended filament source of light a spot beam which is substantially more uniform across its disc as is produced by a conventional parabolic reflector, and a greatly improved broad beam without unilluminated areas. Furthermore, the range of distances in which these effects are provided is importantly increased.

2. An improved flashlight which does not necessarily produce both a spot beam and a broad beam, but whose reflector produces either one of said types of beam with substantial uniformity of luminosity across its disc, utilizing a filament for a light source.

3. Adjustment means for any type of flashlight that utilizes a filament for a light source, which can align the filament with the central axis of the reflector so as to reduce distortions of the beam which were caused by off-axis placement of the filament.

This invention is not to be limited by the embodiments shown in the drawings and described in the description, which are given by way of example and not of limitation, but only in accordance with the scope of the accompanying claims.

I claim:

1. An improved reflector for a flashlight, said reflector having an internal reflective surface of revolution, a central axis, a smaller end, and a larger end, said surface near its smaller end having an aperture therethrough to pass a flashlight lamp, said lamp including a light-emitting source, and adjacent to said aperture a peripheral true paraboloidal region having a focus, the improvement comprising:

said reflector surface as its extends axially away from said true paraboloidal region departing from the shape of a continuation of the true paraboloidal region by gradual change of diameter as it extends from station to station toward said larger end to form a modified parabolic surface, whereby the angle between a tangent to the modified surface and the central axis is changed, so that when said source is spaced from the focus to form a broad beam, the pattern of the reflected rays crosses or diverges from the central axis at a sufficient range from the reflector to form a substantially continuous broad beam pattern, and when the source is disposed at the focus, the reflected rays form a substantially continuous spot beam pattern.

2. A reflector according to claim 1 in which the diameter of said modified parabolic surface is greater than the true paraboloid as the diameter of the true parabolic surface increases to provide said broad beam when the source is intended to be spaced from the focus in the direction of the larger end.

3. A reflector according to claim 1 in which the diameter of said modified parabolic surface is less than the true paraboloid as the diameter of the true parabolic surface increases to provide said broad beam when the source is intended to be spaced from the focus in the direction of the smaller end.

4. An improved reflector for a flashlight, said reflector having an internal reflective surface of revolution, a central axis, a smaller end, and a larger end, said surface near its smaller end having an aperture therethrough to pass a flashlight lamp, said lamp including a light-emitting source, and adjacent to said smaller end a peripheral true paraboloidal region having a focus, said reflector having the capability of forming a spot beam when the source is disposed at the focus, or a broad beam when the source is axially spaced from the focus, said bulb and said reflector being mounted to a base, and are axially movable relative to one another, whereby selectively to generate either a spot beam or a broad beam, the improvement comprising:

said reflecting surface as it extends axially from said true paraboloidal region having a center region increasing in diameter as the diameter of the true paraboloid increases and also increasing the angle between a tangent to the surface at an axial station and the central axis both diameter and tangent being relative to a theoretical continuation of said true paraboloid, a region of the resulting modified surface being such that as the surface extends toward the larger end, the rays from the lamp that are displaced from said focus towards said larger end tend progressively to be reflected less inwardly whereby to form a pattern while crossing the central axis at a sufficient range from the reflector, said rays reflected from said smaller diameter illuminating the outer rim of the broad beam, and the rays reflected from said larger end illuminating the center of the broad beam when the lamp is at the broad beam setting, said rays reflected from both the smaller and larger end of the reflector illuminating the spot beam when the source is source at the focus of the true peripheral paraboloidal region.

5. The reflector of claim 4 in which the reflector is not a complete surface of revolution but instead has one or more intermediate surfaces in order to decrease the size of the reflector in the direction of said intermediate surfaces.

6. The reflector according to claim 4 in which the maximum diameter surface is extended further to provide additional reflector area having an angle relative to the central axis such that the reflected light rays further illuminate the center region of the broad beam thereby to produce a brighter spot therein.

7. The reflector according to claim 4 wherein the reflective surface between the maximum and minimum diameter sections is a linearly modified paraboloid.

8. The reflector according to claim 7 wherein the slope of the reflective surface relative to the central axis is increased linearly with the radius of the reflector relative to the theoretical paraboloid.

9. The reflector according to claim 7 wherein the reflective surface is a modified paraboloid whose slope is increased linearly with the axial distance from the smaller diameter relative to the theoretical paraboloid.

10. The reflector according to claim 7 wherein the slope of the reflective surface is increased in a monotonical fashion with the axial position from the smaller diameter relative to the theoretical paraboloid.

11. The reflector according to claim 4 where the reflective surface is a modified paraboloid whose slope is increased with axial distance from the minimum diameter to the maximum diameter relative to the theoretical paraboloid so as to terminate at said maximum diameter with a slope such that the reflected rays from the source at the broad beam setting will emerge parallel to the axis of the reflector so as to illuminate the center of the broad beam.

12. The reflector according to claim 4 in which the reflector is adjustable radially relative to the light bulb to correct for off of axis lamp filament source placement.

13. The flashlight according to claim 4 in which the light bulb is adjustable radially relative to the reflector to correct for off of axis lamp filament source placement.

14. The flashlight according to claim 4 in which the reflector is adjusted angularly relative to the light bulb axis to correct from misoriented lamp filament source.

15. The flashlight according to claim 4 in which the light bulb is adjustable angularly relative to the reflector to correct for misoriented lamp filament source.

16. The reflector according to claim 4 wherein the slope of the surface at the maximum diameter is such as to reflect the rays in a direction to illuminate an area of the spot beam no farther from the flashlight centerline axis than the rays reflected from its paraboloidal region at the smaller diameter.

17. An improved reflector for a flashlight, said reflector having an internal reflective surface of revolution, a central axis, a smaller end, and a larger end, said surface near its smaller end having an aperture therethrough to pass a flashlight lamp, said lamp including a light-emitting source, and adjacent to said smaller end a peripheral true paraboloidal region having a focus, said reflector having the capability of forming a spot beam when the source is disposed at the focus, or a broad beam when the source is axially spaced from the focus, said bulb and said reflector being mounted to a base, and are axially movable relative to one another, whereby selectively to generate either a spot beam or a broad beam, the improvement comprising:

said reflecting surface as it extends axially from said true paraboloidal region having a center region decreasing in diameter as the diameter of the true paraboloid increases and also decreasing the angle between a tangent to the surface at an axial station and the central axis both diameter and tangent being relative to a theoretical continuation of said true paraboloid, a region of the resulting modified surface being such that as the surface extends toward the larger end, the rays from the source that are displaced from said focus towards said smaller end tend progressively to be reflected less outwardly whereby to diverge from the central axis, said rays that are reflected from the smaller diameter illuminating the outer rim of the broad beam and the rays reflected from the larger end to illuminate the center of the broad beam when the source is at the broad beam setting, said rays reflected from both the smaller end and larger end to illuminate the spot beam when the source is at the focus of the true paraboloidal region.

18. The reflector according to claim 17 in which the reflector is not a complete surface of revolution but instead has one or more intermediate surfaces in order to decrease the size of the reflector in the direction of the intermediate surfaces.

19. The reflector according to claim 17 in which the maximum diameter surface is extended further to provide additional reflector area having an angle relative to the central axis such that the reflected light rays further illuminate the center region of the broad beam thereby to produce a brighter spot therein.

20. The reflector according to claim 17 wherein the reflective surface between the maximum and minimum diameter sections is a linearly modified paraboloid.

21. The reflector according to claim 20 where the slope of the reflective slope is decreased linearly with the radius relative to the theoretical paraboloid.

22. The reflector according to claim 20 wherein the reflective surface is a modified paraboloid whose slope is decreased linearly with axial distance from the smaller diameter relative to the theoretical paraboloid.

23. The reflector according to claim 20 wherein the slope of the reflective surface decreases in a monotonical fashion with axial position from the smaller diameter relative to the theoretical paraboloid.

24. The reflector according to claim 17 wherein the reflective surface is a modified paraboloid whose slope decreases with the axial distance from the minimum diameter to the maximum diameter relative to the theoretical paraboloid so as to terminate at a maximum diameter with a slope such that the reflected rays from the source when the filament is located at the broad beam setting will emerge parallel to the axis of the reflector so as to illuminate the center of the broad beam.

25. The reflector according to claim 17 in which the reflector is adjustable radially relative to the reflector to correct for off of axis lamp filament source placement.

26. The flashlight according to claim 17 in which the light bulb is adjustable radially relative to the reflector to correct for off of axis lamp filament source placement.

27. The flashlight according to claim 17 in which the reflector is adjustable angularly relative to the light bulb axis to correct for misoriented lamp filament source.

28. The flashlight according to claim 17 in which the light bulb is adjustable angularly relative to the reflector to correct for misoriented lamp filament source.

29. The reflector according to claim 17 wherein the slope of the surface at the maximum diameter is such as to reflect the rays in a direction to illuminate an area of the spot beam no farther from the flashlight centerline axis than the rays reflected from its paraboloidal region at the smaller diameter.

* * * * *